United States Patent [19]

Hendrickson et al.

[11] 4,296,807

[45] Oct. 27, 1981

[54] CROSSOVER TOOL

[75] Inventors: James D. Hendrickson, Carrollton; Pat M. White, Lewisville, both of Tex.

[73] Assignee: Halliburton Company, Duncan, Okla.

[21] Appl. No.: 107,752

[22] Filed: Dec. 27, 1979

[51] Int. Cl.[3] ..... E21B 33/124

[52] U.S. Cl. ..... 166/184; 166/334; 166/240; 166/150

[58] Field of Search ..... 166/150, 152, 184, 334, 166/240

[56] References Cited

U.S. PATENT DOCUMENTS

| | | | |
|---|---|---|---|
| 2,649,916 | 8/1953 | Brown | 166/150 |
| 2,738,012 | 3/1956 | Springer | 166/150 |
| 3,637,010 | 1/1972 | Maly | 166/51 |
| 3,710,862 | 1/1973 | Young et al. | 166/278 |
| 3,726,343 | 4/1973 | Davis, Jr. | 166/51 |
| 3,797,572 | 3/1974 | Mignotte | 166/127 |
| 3,926,409 | 12/1975 | Abney et al. | 251/344 |
| 4,044,832 | 8/1977 | Richard et al. | 166/278 |

*Primary Examiner*—James A. Leppink

*Attorney, Agent, or Firm*—Joseph A. Walkowski; John H. Tregoning

[57] ABSTRACT

A crossover tool for use with concentric tubing strings. The apparatus disclosed provides the ability to treat and/or gravel pack a producing zone in a well, and is particularly suited for use in a multiple-zone well. The crossover tool may be locked in any one of three positions: a circulate mode, a closed test mode, or a closed bypass mode to facilitate movement of the tool within the well bore. All operation of the crossover tool is effected by reciprocation of the pipe string to which it is attached. Alternative embodiments are also disclosed which dispense with the closed test mode.

23 Claims, 33 Drawing Figures

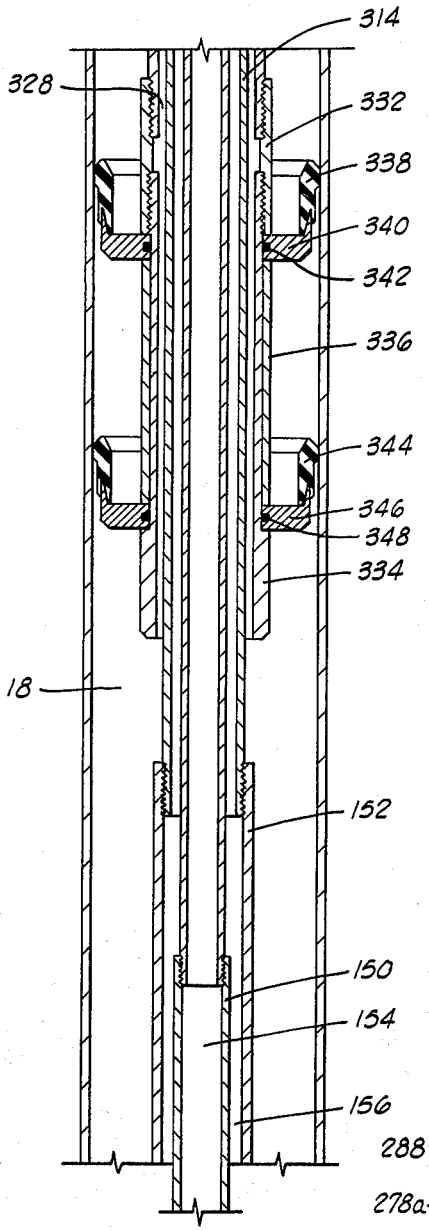
FIG. 6C
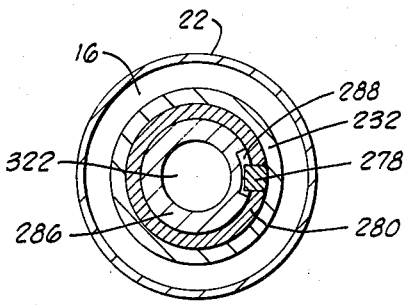
FIG. 5
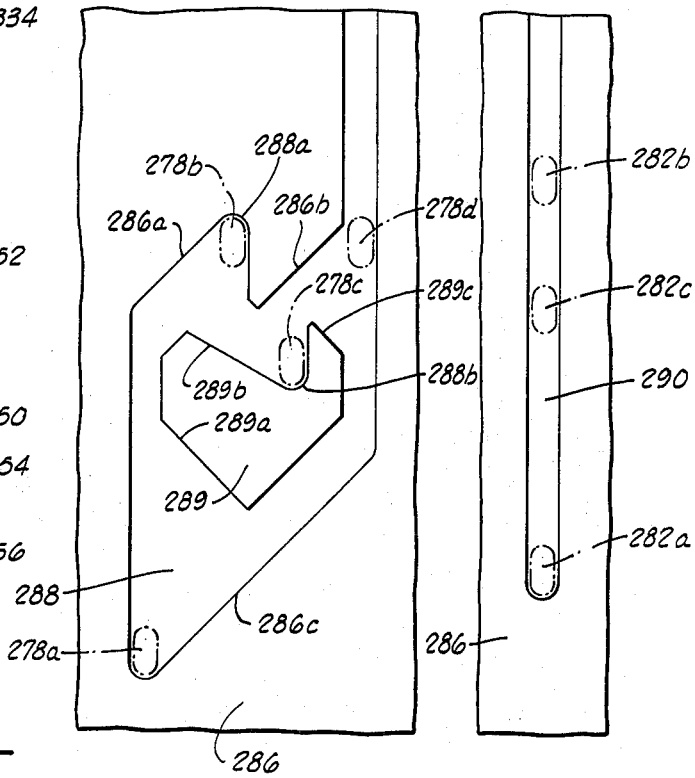
FIG. 6B
FIG. 6A

CROSSOVER TOOL

SUMMARY OF THE INVENTION

Unconsolidated formations, particularly those containing loose sands and soft sandstone strata, present constant problems in well production due to migration of loose sands and degraded sandstone into the well bore as the formation deteriorates under the pressure and flow of fluids therethrough. This migration of particles may eventually clog the flow passages in the production system of the well, and can seriously erode the equipment. In some instances, the clogging of the production system may lead to a complete cessation of flow, or "killing" of the well.

One method of controlling sand migration into a well bore consists of placing a pack of gravel on the exterior of a perforated or slotted liner or screen which is positioned across an unconsolidated formation to present a barrier to the migrating sand from that formation while still permitting fluid flow. The gravel is carried to the formation in the form of a slurry, the carrier fluid being removed and returned to the surface. The proper size of gravel must be employed to effectively halt sand migration through the pack, the apertures of the liner or screen being gauged so that the gravel will settle out on its exterior, with the slurry fluid carrying the gravel entering the liner or screen from its exterior and returning to the surface after passing through it.

"Reverse circulation" is a widely employed procedure by which wells are gravel packed. Currently, a liner assembly having a perforated liner or screen is positioned across the unconsolidated formation, commonly referred to as the "zone" to be packed, after which a packer is set above the zone between the liner and the well casing, (or, if unlined, the well bore wall) to isolate that zone from those above. A tubing string is run inside the liner assembly at the area of the zone, there being created between the liner and inner tubing string and annulus. Gravel slurry is pumped down this annulus, out into the annulus between the liner and the casing at a suitable location above the zone where it descends and the gravel is deposited in the area of the screen as the carrier fluid passes through the screen in the liner assembly, being removed from the zone area through the inner tubing string. A crossover tool routes the returning fluid back outside the liner assembly, the fluid then traveling up to the surface. A pressure buildup is noted at the surface as the gravel level reaches the top of the screen, indicating that a successful pack has been achieved. Thereafter, the flow of gravel-laden fluid is stopped. If desired, the crossover tool may then be closed and pressure applied in the same direction as the slurry flow to squeeze the slurry into the formation, thus consolidating the gravel pack. After squeezing, the crossover tool is opened again and the circulation of fluid is reversed, a clean fluid being pumped down the inner tubing and back up the annulus between it and the liner assembly in order to flush out this area. Subsequently, the well may be subjected to other treatments if necessary, and produced.

As an alternative to employing a crossover tool to route returning fluid outside the liner assembly when gravel packing, it is known in the prior art to employ concentric inner and outer tubing strings above the zone being packed, utilizing a crossover tool to route returns to the tubing-to-tubing annulus, then up to the surface. Such an apparatus is disclosed in U.S. Pat. No. 4,044,832. The crossover tool illustrated therein is actually part of a gravel packing assembly, and is not a unitary tool per se, but a portion of an inner tubing string which cooperates at certain sealing points with the liner assembly to route fluid in various paths. Furthermore, the operation of the crossover mechanism is admittedly dependent upon the upward and downward movement of the inner tubing string a predetermined distance, no easy task in deep and highly deviated holes. Moreover, the incorporation of the crossover tool into the packing apparatus itself, coupled with the requirement that the crossover assembly engage the liner assembly in the vicinity of the zone to close the circulation path, limits the employment of the apparatus to single-zone wells. There is no way to lock the crossover tool either open or closed, rendering a squeeze of the gravel pack an uncertain procedure. Finally, utilizing both a crossover tool and concentric tubing strings to the surface defeats one purpose of a crossover tool, that of eliminating dual tubing strings to the surface.

Another alternative in crossover tools is disclosed in U.S. Pat. No. 3,710,862, wherein a crossover tool which can be locked open or closed through the use of an internal rotating J-slot mechanism. However, this crossover tool is again a part of the gravel packing apparatus per se, and returns fluid up to the surface past the casing, a technique which can result in the disturbance of higher formations in a multiple-zone well. The design and location of the crossover tool renders it impossible to gravel pack more than one zone in a single trip into the well, and the method of determining whether the crossover tool is open or closed by measurement at the surface is highly impractical in deep or deviated wells due to the probability of stretch in the pipe string and hangups between the pipe and liner.

U.S. Pat. No. 3,426,409 discloses a crossover tool as an integral part of a gravel packing apparatus, and having a J-slot mechanism to lock the crossover open or closed. However, employing a J-slot necessarily requires rotation of the pipe string, difficult to control in deep or deviated wells, and the manner in which the crossover is incorporated in another apparatus prohibits its use for multiple operations at different zones in a well during the same trip.

The present invention, by comparison, overcomes the deficiencies and problems associated with the prior art as it contemplates a unitary crossover tool deployed at the top of concentric strings of tubing in a multiple-zone well. The crossover tool of the present invention comprises an outer sleeve disposed about an inner body, which contains vertical passages therein for fluid communication between the pipe string by which the crossover tool is suspended in the well and the annulus between the concentric strings of tubing below it, as well as lateral circulation passages which communicate with the interior of the inner tubing string below. The aforesaid lateral passages, when aligned with ports in the outer sleeve, allow fluid flow between the outer annulus (between drill pipe and casing or open hole wall) and the inner tubing string below the crossover tool. The crossover may be locked either in the circulate mode, in a closed test mode, or in a closed bypass mode through the use of internal rotating slot mechanism and collet snap-ring assembly. All operation of the tool is effected by upward and downward reciprocation of the pipe string from which the crossover tool (and other tools in the string below it) are suspended. Because the crossover tool of the present invention is deployed above the highest zone in the well, all returns are taken to the top of the liner through the tubing-to-tubing annulus, thereby isolating the zones above the one being packed. In addition, because the crossover is so located, returns can be taken in the casing-pipe annulus without the necessity of running dual tubing strings to the surface. Multiple zone packing in a single trip is also feasible, as the crossover tool does not depend on engagement with the liner at any point for operation. Finally, movement of the tool string within the well is also facilitated through the use of bypasses which are also locked open or closed through reciprocation of the pipe string.

Alternative embodiments of the present invention are also disclosed. A first alternative embodiment dispenses with the closed test mode, while still employing the same type actuating mechanism. The second alternative embodiment employs a simplified snap-ring actuation device, eliminating the rotating slot mechanism.

BRIEF DESCRIPTION OF THE DRAWINGS

FIGS 6A, 6B, and 6C provide a vertical cross-sectional elevation of an alternative embodiment of the present invention in its circulate mode.

FIGS. 8A and 8B show developments of the slots employed in the crossover tool of FIGS. 6 and 7.

FIG. 9 is a horizontal cross-section taken across line x—x of FIG. 6.

DESCRIPTION OF THE PREFERRED EMBODIMENT

Figure 1A:
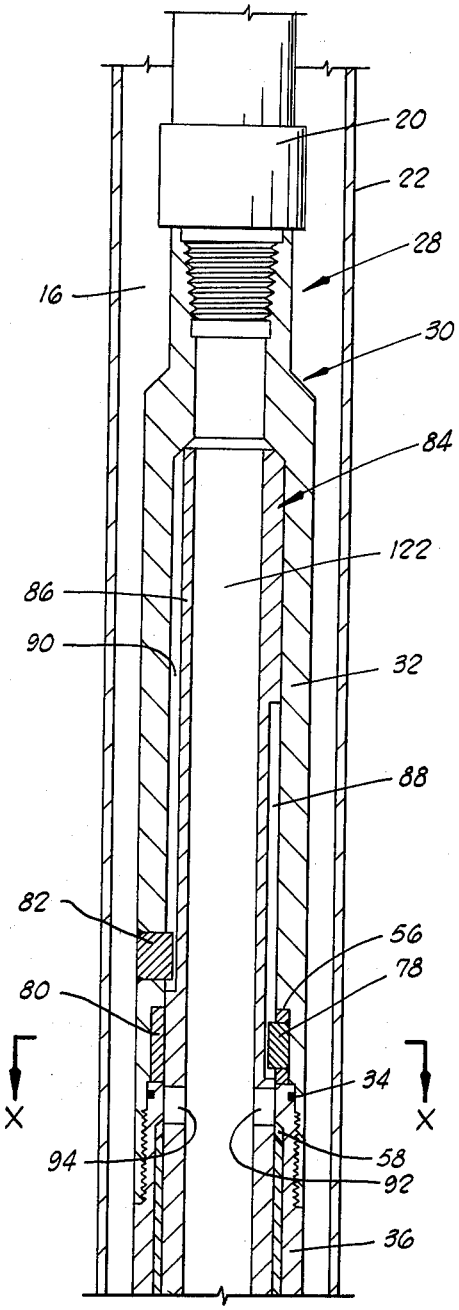
FIGS. 1A, 1B, 1C and 1D provide a vertical cross-sectional elevation of the crossover tool of the present invention in its circulate mode.
Figure 1B:
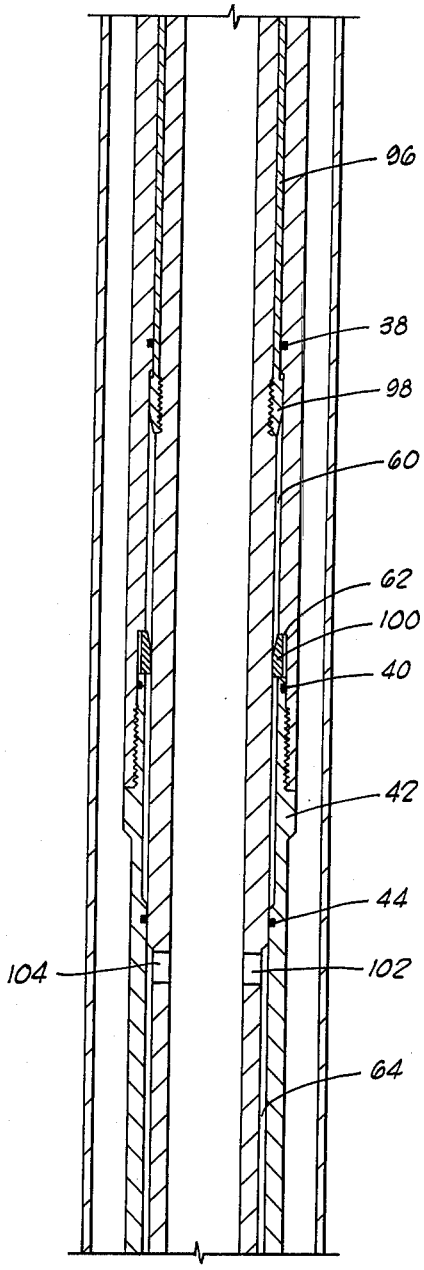
Figure 1C:
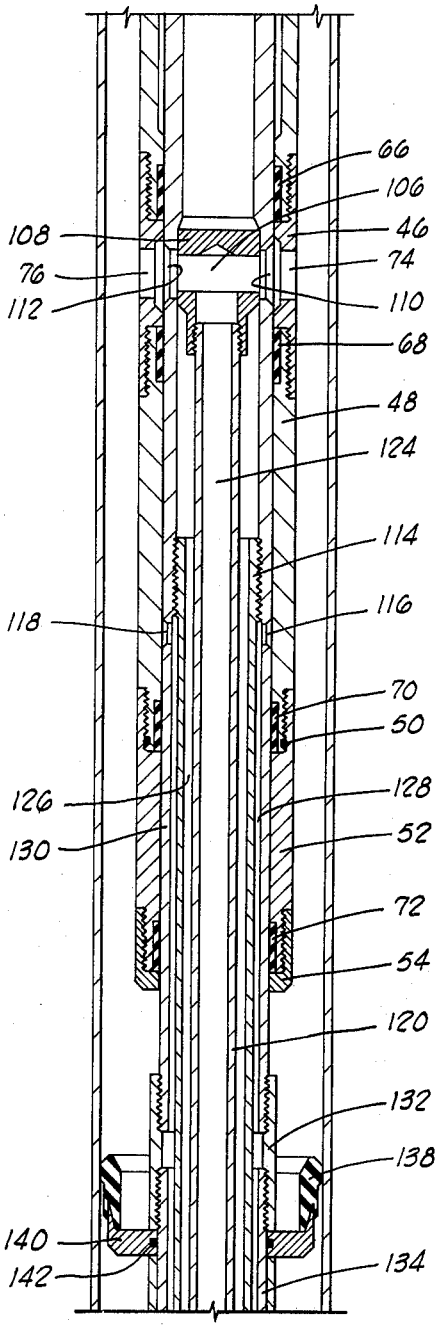
Figure 1D:
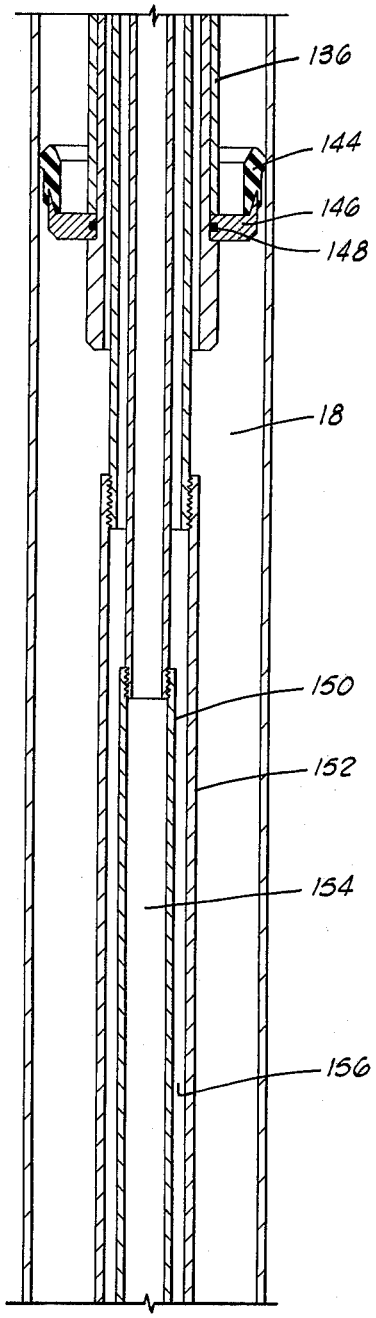
Figure 2A:
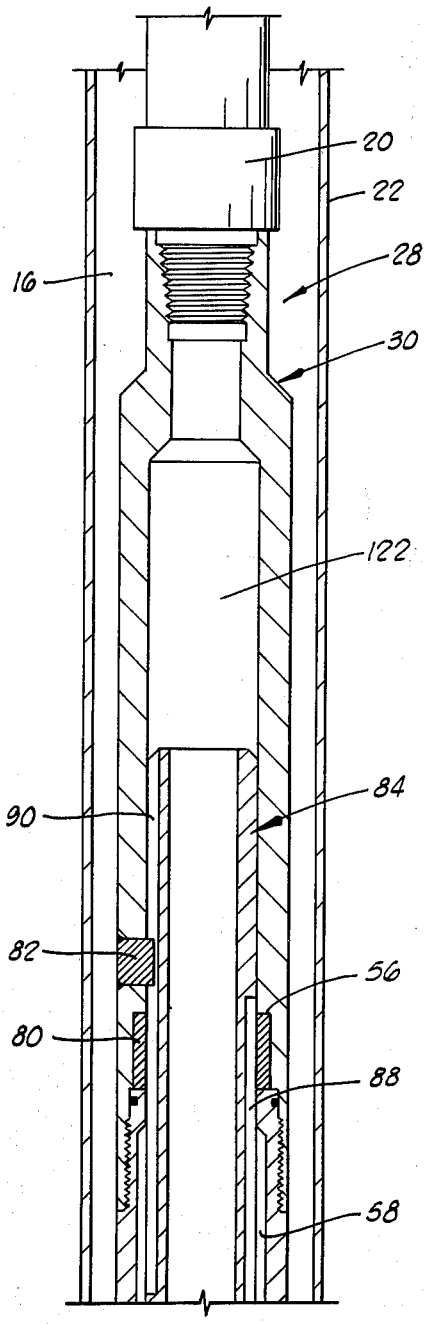
FIGS. 2A, 2B, 2C and 2D provide a vertical cross-sectional elevation of the crossover tool in its closed test mode with bypass closed.
Figure 2B:
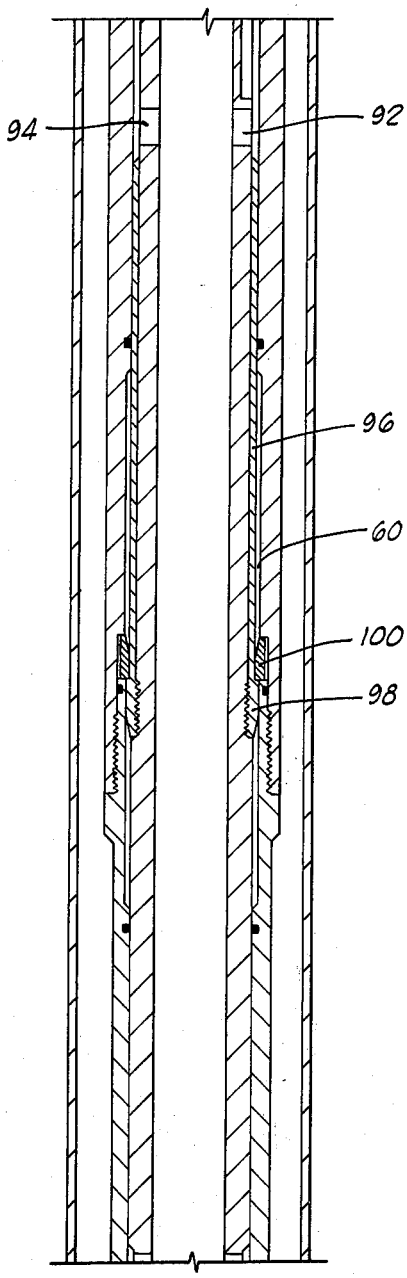
Figure 2C:
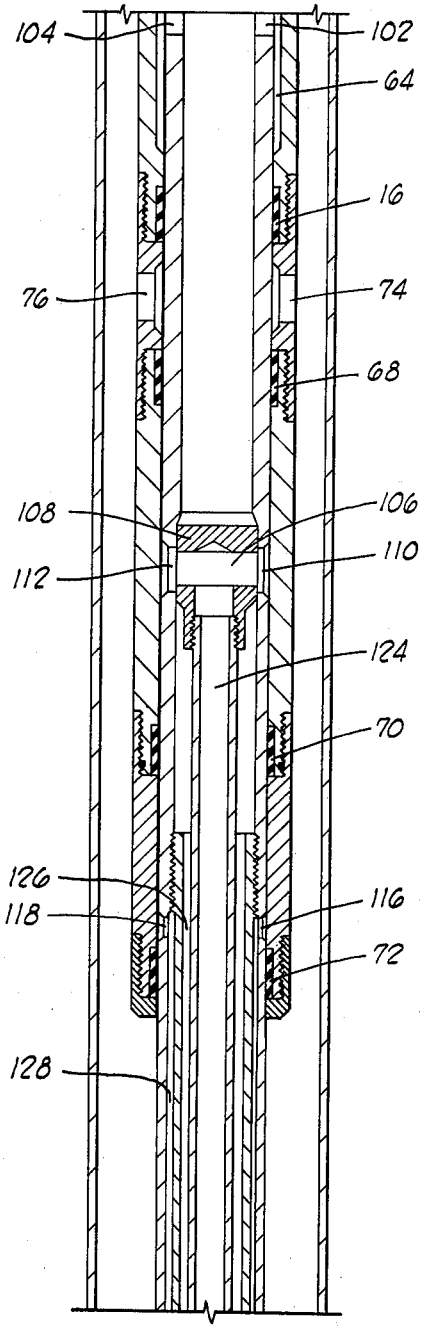
Figure 2D:
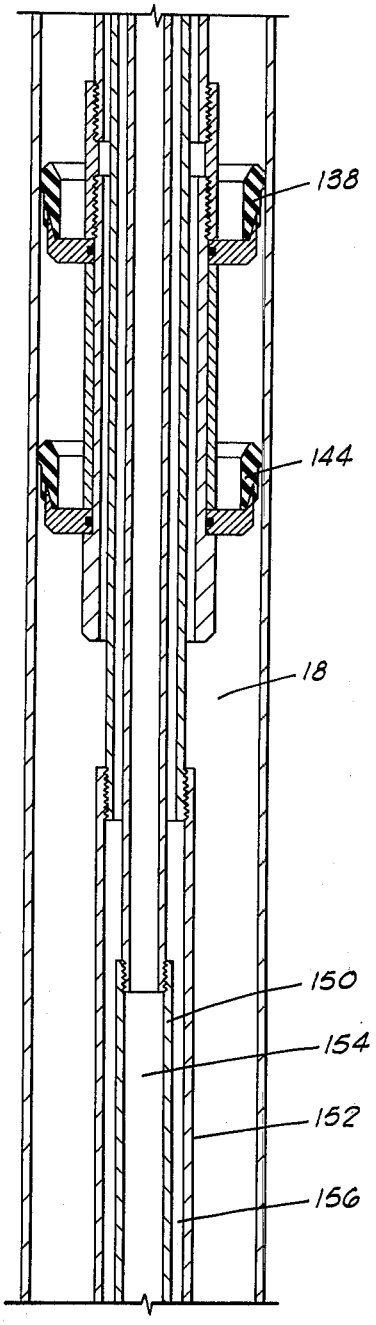
Figure 3A:
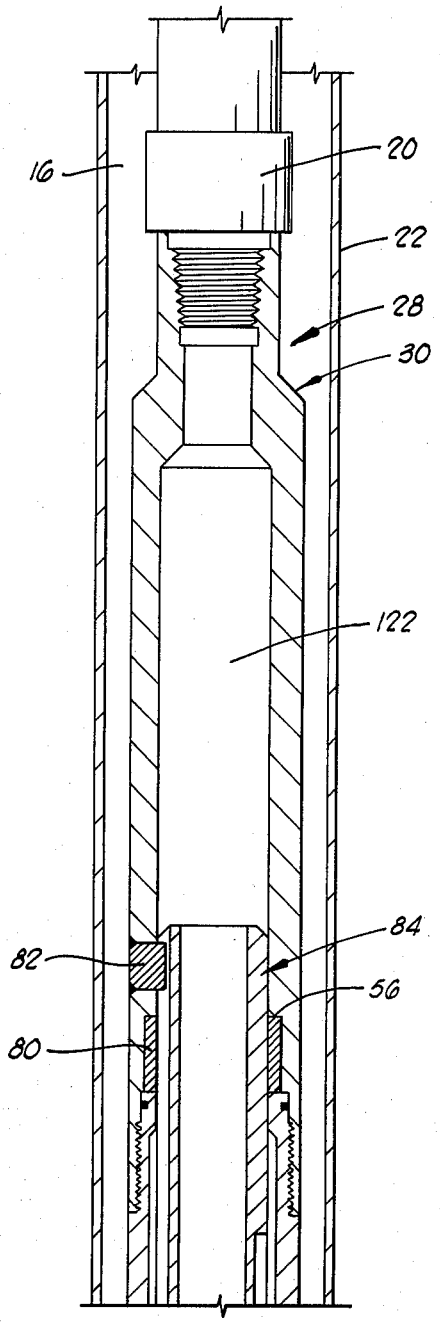
FIGS. 3A, 3B, 3C and 3D provide a vertical cross-sectional elevation of the crossover tool in its closed bypass mode with bypass open.
Figure 3B:
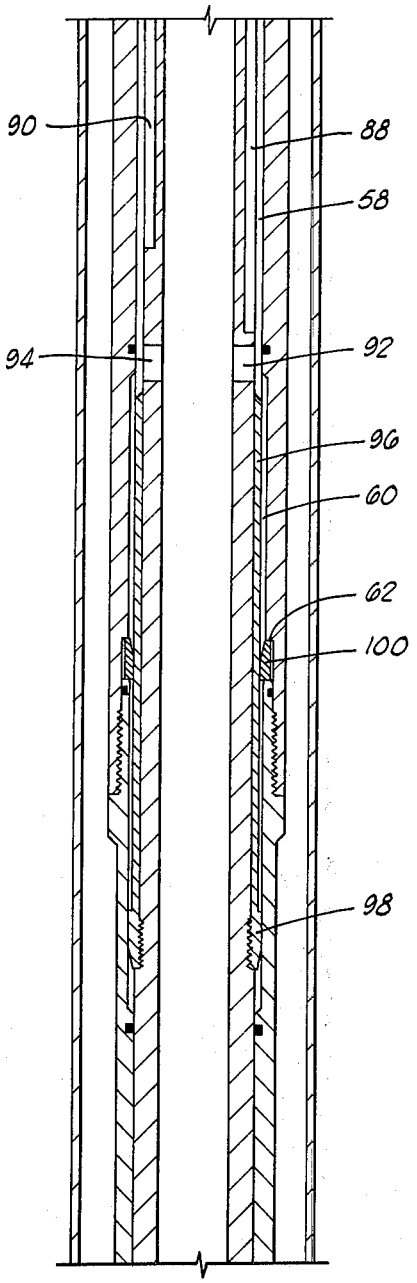
Figure 3C:
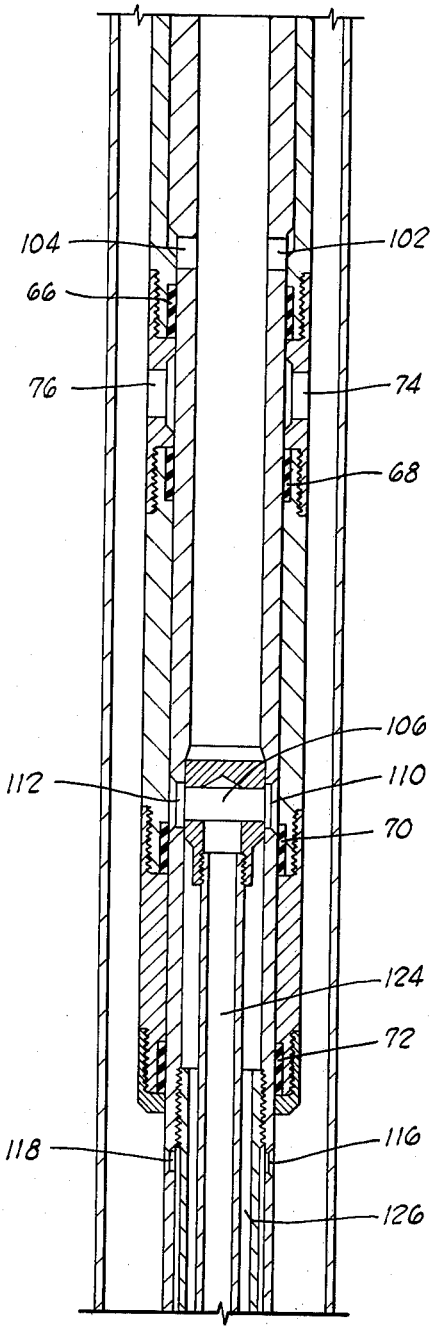
Figure 3D:
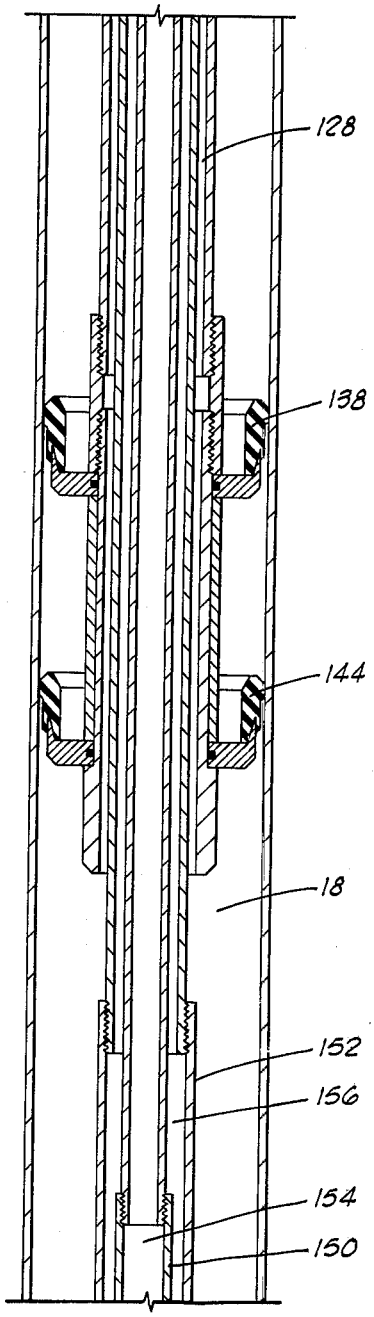

Referring to the drawings, and FIGS. 1A, 1B and 1C in particular, crossover tool 28 depends from drill pipe 20, disposed in casing 22. Crossover tool 28 comprises body 84 about which is slidably disposed sleeve 30, attached to drill pipe 20 running to the surface.

Outer sleeve 30, as shown for purposes of illustration and not by way of limitation, is assembled from individual section. Adapter sleeve 32, by which crossover tool 28 (and the tool string below it) is hung, threadably engages upper collet sleeve 36, a fluid seal being achieved therebetween by O-ring 34. Upper collet sleeve 36 is in turn threadably attached to lower collet sleeve 42, with O-ring 40 being interposed. The lower end of lower collet sleeve 42 is attached to circulation port housing 46, below which is upper seal sleeve 48, lower seal sleeve 52 (with O-ring 50 therebetween) and end cap 54. The junction of adapter sleeve 32 and upper collet sleeve 36 creates annular housing 56, in which is rotationally slidably disposed ring 80 carrying pin 78. Pin 82 is fixed to adapter sleeve 32 in a position above ring housing 56. Below housing 56, upper collet sleeve 36 possesses an enlarged bore for a substantial distance, below which the bore is further enlarged to create the upper portion of snap-ring annulus 60. The junction of upper collet sleeve 36 and lower collet sleeve 42 creates annular snap-ring housing 62, below which the bore of lower collet sleeve 42, corresponding in inner diameter to that of upper collet sleeve 36 above snap-ring housing 62, forms the lower portion of snap-ring annulus 60.

Annular seal 66 is housed at the junction of lower collet sleeve 42 and circulation port housing 46, annular seal 68 being housed at the junction of the latter and upper seal sleeve 48. Circulation ports 74 and 76 are disposed between annular seals 66 and 68, extending through the wall of sleeve 30 and circulation port housing 46. Annular seal 70 is constrained between upper seal sleeve 48 and lower seal sleeve 52, annular seal 72 being contained in the housing formed at the joinder of lower seal sleeve 52 and end cap 54. Body 84 comprises substantially tubular mandrel 86 with bore 122 running uninterrupted to circulation block 108. Circumferentially spaced slots 88 and 90 are machined on the outer surface of mandrel 86; developments of slots 90 and 88 are shown in FIGS. 5A and 5B. Axially below the slots, upper sleeve bypasses 92 and 94 extend from the bore to the outer surface of mandrel 86. Immediately below upper sleeve bypasses 92 and 94 commences upper sleeve bypass annulus 58 (which is variable in length, as will be explained hereafter), defined primarily by the bore wall of adapter sleeve 32 and the outer surface of mandrel 86. Surrounding and threadably attached to mandrel 86 below the upper sleeve bypasses is collet skirt 96, having collet 98 at the lower end thereof, collet 98 having a radially inwardly tapered lower surface communicating with the outer surface of mandrel 86, a uniform flat median surface, and a radially inward extending upper shoulder communicating with the cylindrical upper portion of collet skirt 96. Wiper ring 38, housed in upper collet sleeve 36, is in slidable wiping contact with collet skirt 96 above collet 98. Below collet skirt 98, the outer diameter of mandrel 86 is increased slightly, this surface extending to lower sleeve bypasses 102 and 104, which bypasses extend between the bore and the outer surface of mandrel 86. It is noted that the outer diameter of the cylindrical upper portion of collet skirt 96 is greater than that of mandrel 86 below collet 98. Snapring 100, having an outwardly beveled annular surface at the upper extent of its interior and a flat annular surface therebelow, will slide substantially freely on outer surface of mandrel 86 below collet 98, but will slide with substantial friction on the cylindrical upper portion of collet skirt 96. Wiper ring 44, housed in lower collet sleeve 42, is in slidable wiping contact with the outer surface of mandrel 86 below collet skirt 96. Commencing proximate the axially upper extent of lower sleeve bypasses 102 and 104, and continuing axially downward to a point near annular seal 66, mandrel 86 is of reduced outer diameter, forming variable length lower sleeve bypass annulus 64 in conjunction with the bore wall of lower collet sleeve 42, which lower sleeve bypass annulus 64 is in communication with lower sleeve bypasses 102 and 104. Circulation block 108 containing "tee" shaped circulation passage 106 is welded to the bore wall of mandrel 86 in juxtaposition with apertures 110 and 112, circulation block 108 being spaced from the bore wall of mandrel 86 on either side of circulation passage 106 so as to permit fluid flow thereby from bore 122 to annular crossover passage 126. Apertures 110 and 112 are circumferentially aligned with circulation ports 74 and 76. Inner conduit 120, defining axial crossover passage 124, is fixed to circulation block 108 in communication with circulation passage 106. Outer conduit 114 is fixed to mandrel 86 above tool bypasses 116 and 118, which extend between the outer surface of mandrel 86 and tool bypass annulus 128.

Packer cups 138 and 144 are mounted on collars 140 and 146, respectively, and disposed about packer mandrel 134, O-rings 142 and 148 forming a fluid-tight seal therebetween. Collar 146 abuts the enlarged lower end of packer mandrel 134, and is axially spaced from collar 140 by collar sleeve 136. Crossover adapter 132, attached to both packer mandrel 134 and mandrel 86, axially constrain collars 140 and 146 and collar sleeve 136.

Inner blank pipe 150 is attached to inner conduit 120, axial crossover passage 124 thus communicating with blank pipe bore 154 and outer blank pipe 142 is attached to outer conduit 114, blank pipe annulus 156 thus communicating with annular crossover passage 126.

OPERATION OF THE PREFERRED EMBODIMENT

Figure 4A:
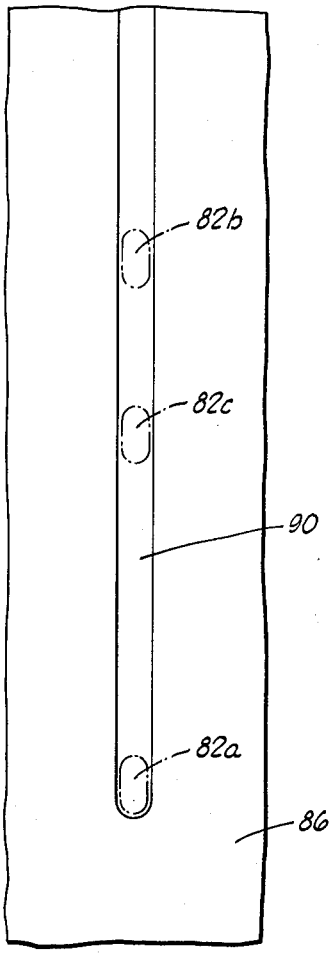
FIGS. 4A and 4B show developments of the slots employed in operation of the present invention.
Figure 4B:
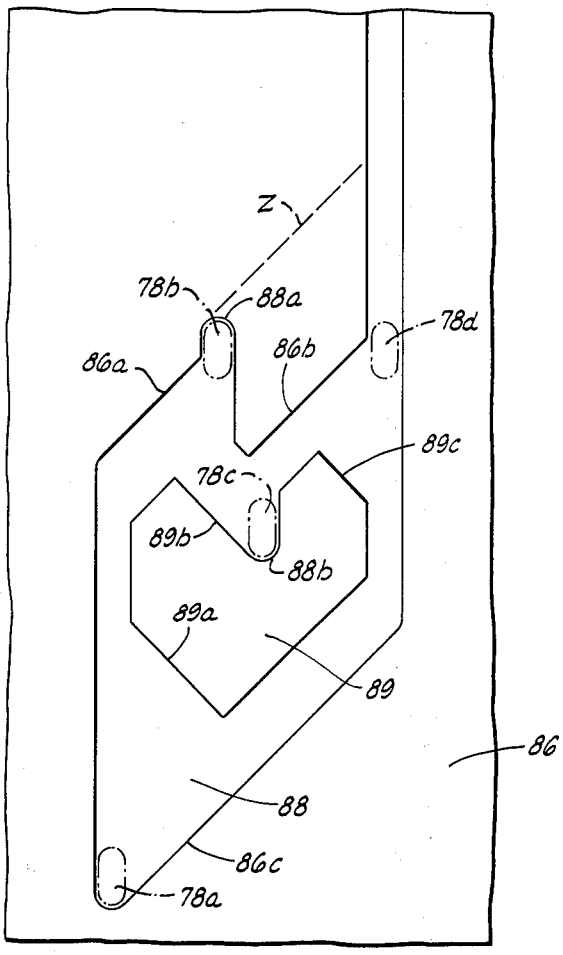
Figure 5:
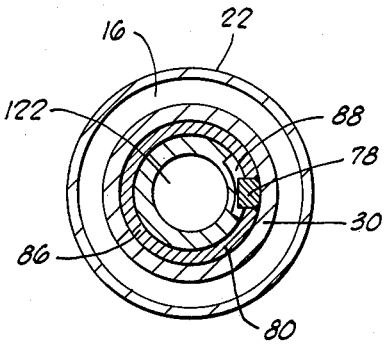
FIG. 5 is a horizontal cross-section taken across line x—x of FIG. 1A.

FIGS. 1 through 5 are of particular relevance to the understanding of the operation of crossover tool 28, which utilizes an internal rotating slot mechanism in conjunction with a snap-ring collet assembly. Outer sleeve 30 being slidably disposed about body 84, movement of the outer sleeve 30 by virtue of reciprocation of drill pipe 20 effects changes of mode in crossover tool 28 from an open mode (FIG. 1) to a closed test mode (FIG. 2) to a closed bypass mode (FIG. 3). When crossover tool 28 is in the open mode as shown in FIG. 1, circulation ports 74 and 76 in outer sleeve 30 are juxtaposed with apertures 110 and 112, circulation passage 106 extending therefrom to axial circulation passage 124. In the open mode, apertures 110 and 112 are bracketed by annular seals 66 and 68, while annular seals 68 and 70 bracket tool bypasses 116 and 118 in body 84, thus isolating annulus 16 from annulus 18 below crossover tool 28. In the closed test mode (FIG. 2), apertures 110 and 112 are bracketed by annular seals 68 and 70, and thus isolated from annulus 16. Tool bypasses 116 and 118 are also closed, as they are bracketed by annular seals 70 and 72. When crossover tool 28 is in the closed bypass mode, as shown in FIG. 3, apertures 110 and 112 are again bracketed by annular seals 68 and 70, thus closing them off from annulus 16, while tool bypasses 116 and 118 are opened. To ensure positive locking in the closed test and closed bypass modes of crossover tool 28, the slot mechanism illustrated in FIGS. 4A, 4B and 5 is employed with snap-ring 100 and collet 98. To ensure that outer sleeve 30 will not rotate with respect to body 84, fixed pin 82 in outer sleeve 30 slides within straight slot 90 in mandrel 86. To provide positive locking in the closed test mode, complex slot 88 in body 84 is utilized with pin 80 and ring 78. Ring 80 is rotationally slidably confined within ring housing 56 in outer sleeve 30 and is rotationally and axially slidable with respect to mandrel 86. Thus, when outer sleeve 30 is reciprocated by movement of drill pipe 20, pin 78 follows the edges of complex slot 88 defined by mandrel 86 and cam island 89 by virtue of the rotational and axial movement capabilities allowed by ring 80. When crossover tool 28 is in the open mode as illustrated in FIG. 1, pin 78 is at position **78*a* in complex slot 88 as shown in FIG. 4B, while pin 82 in straight slot 90 is in position 82*a* as shown in FIG. 4A. FIG. 5, a section across line x—x in FIG. 1A, also illustrates the circumferential position of pin 78 in slot 88 when crossover tool 28 is in the open mode. Straight slot 90 is not shown in FIG. 5 as the section is taken below it. When drill pipe 20 and therefore outer sleeve 30 are reciprocated upward, pin 78 is guided to position 78*b* in slot recess 88*a* by angled edge 89*a* of cam island 89 and angled perimeter slot edge 86*a*, while pin 82 moves to position 82*b*, effecting the closed test mode of crossover tool 28. Snap-ring 100 in housing 62 has, by the aforesaid movement of outer sleeve 30, been raised up and over collet 98 and collet skirt 96, this snap-ring movement being facilitated by the beveled upper inner surface of snap-ring 100. When the drill pipe 20 is set down, pin 78 is guided into position 78*c* in slot recess 88*b* by angled cam island edge 89*b*. Pin 78 also, obviously, moves downward to position 82*c* in straight slot 90. At this point, crossover tool 28 is locked in the closed test mode shown in FIG. 2, and the flat lower surface of snap-ring 100 abuts the upper shoulder of collet 98. Subsequent upward reciprocation of outer sleeve 30 causes pin 78 to be guided into location 78*d* in slot 88 by angled perimeter slot edge 86*b*, at which point the frictional engagement of snap-ring 100 with collet skirt 96 will hold outer sleeve 30 above tool bypasses 116 and 118 (FIG. 3) until substantial weight is set down on the tool string through pipe 20, as, for example when the tool string is anchored at a zone to be treated. It can therefore be seen, as snap-ring 100 will be frictionally riding on collet skirt 96 in positions 78*b* and 78*d*, that tool bypasses 116 and 118 will be uncovered and held open in both of these positions (FIG. 2 shows crossover tool 28 in position 78*c*, after pipe 20 has been set down). As a result, tool bypasses can always be assured of being open unless substantial weight is set down on the drill pipe 20, as when the tool string is in a stationary position. Downward movement of outer sleeve 30, effected with the aforesaid substantial weight, drops pin 78 down to position 78*a*, moving snap-ring 100 back down over collet 98. Snapring 100 is expandable, due to a split therein (not shown) and downward movement over said collet 98 may further be facilitated by a slight beveling of the edge between the inner and lower surfaces of the snap-ring 100 so as to present an oblique face to said collet 98. Pin 78 is prevented from returning to position 78*c* by angled cam island edge 89*c*, then follows angled perimeter slot edge 86*c*. Pin 82, of course, goes to position 82*b* and then 82*a* in straight slot 90** in the same sequence.

Referring again to FIGS. 1 through 3, upper sleeve bypasses 92 and 94, leading to upper sleeve bypass annulus 58, facilitate the movement of outer sleeve 30 with respect to mandrel 86 above snap-ring annulus 60 by allowing fluid passage therebetween from bore 122, thus preventing a vacuum effect. Particulate matter in the fluid in bore 122 are kept away from snap-ring annulus 60 by wiper ring 38. In similar manner, lower sleeve bypasses 102 and 104 in conjunction with lower sleeve bypass annulus 64, facilitate fluid movement between outer sleeve 30 and mandrel 86 below snap-ring annulus 60, particulate matter being retained away therefrom by wiper ring 44. Annular seal 66 serves the same purposes at the lower end of the bypass annulus 64, while effecting a fluid seal. Both bypass annuli, as can be seen, vary in length with sleeve position, their axial dimension varying with the direction of fluid movement.

Figure 12A:
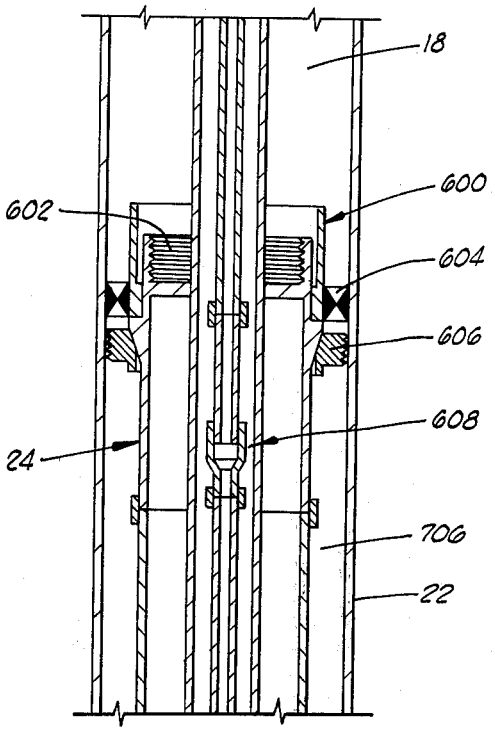
FIGS. 12A, 12B, 12C, 12D and 13 provide a schematic illustration of the use of the crossover tool in gravel packing.
Figure 12B:
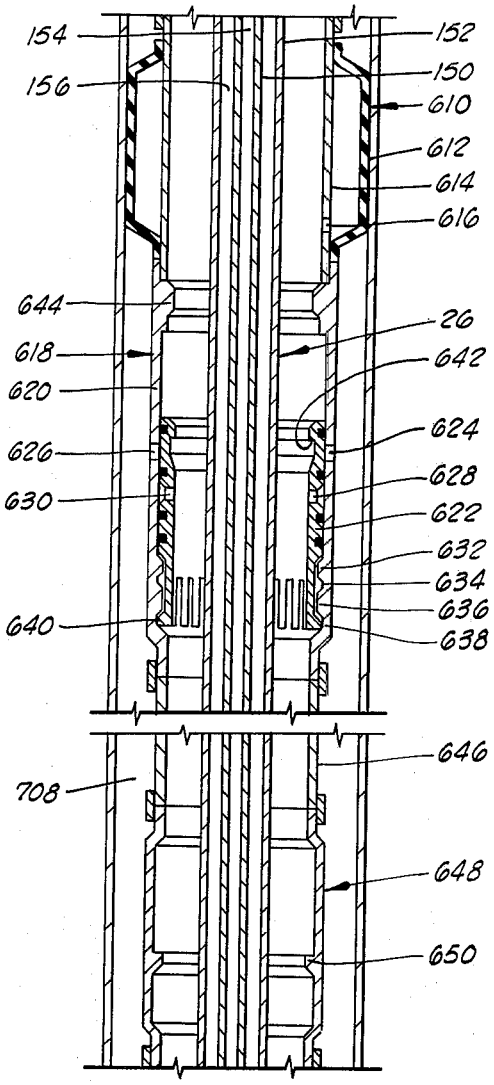
Figure 12C:
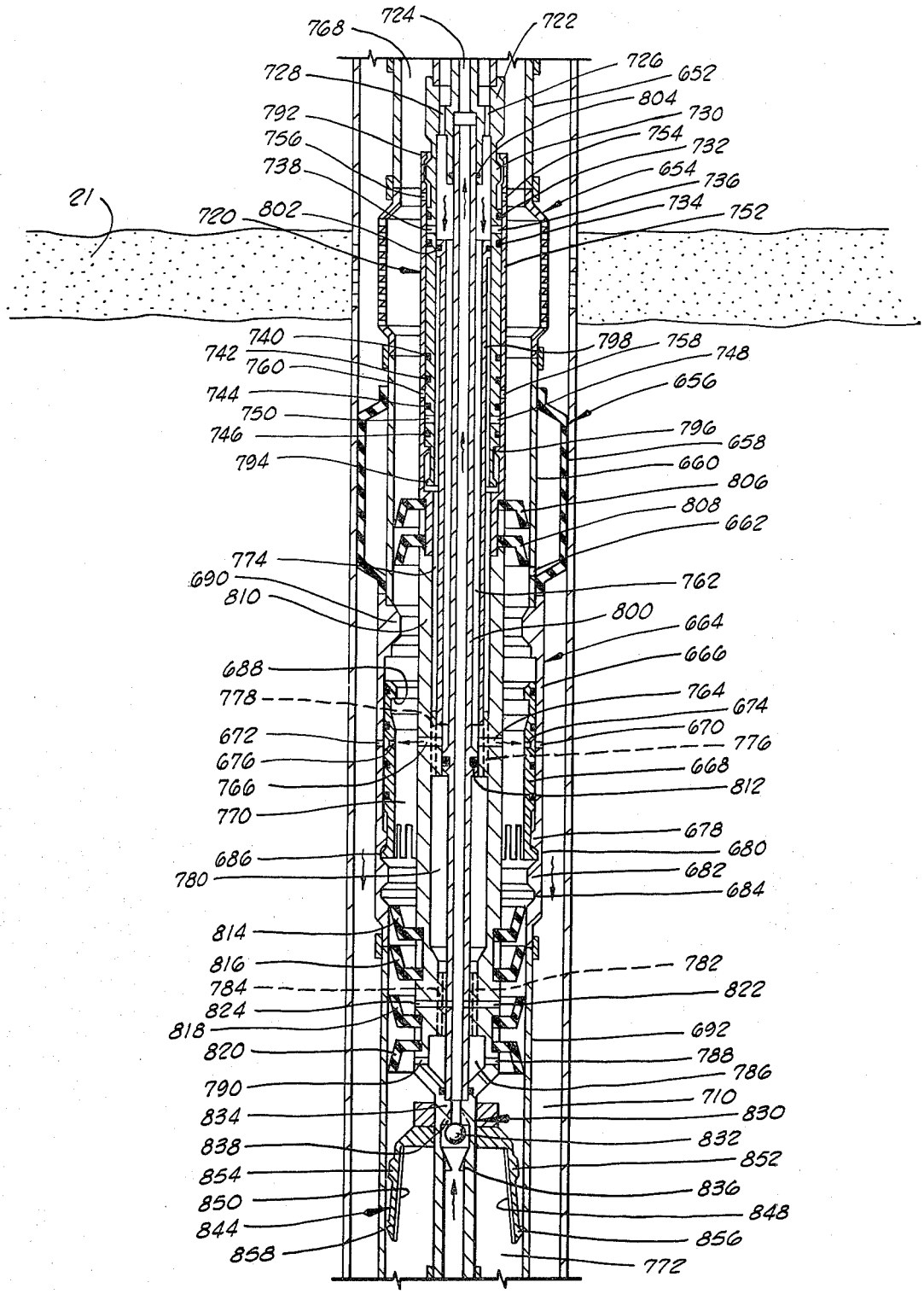
Figure 12D:
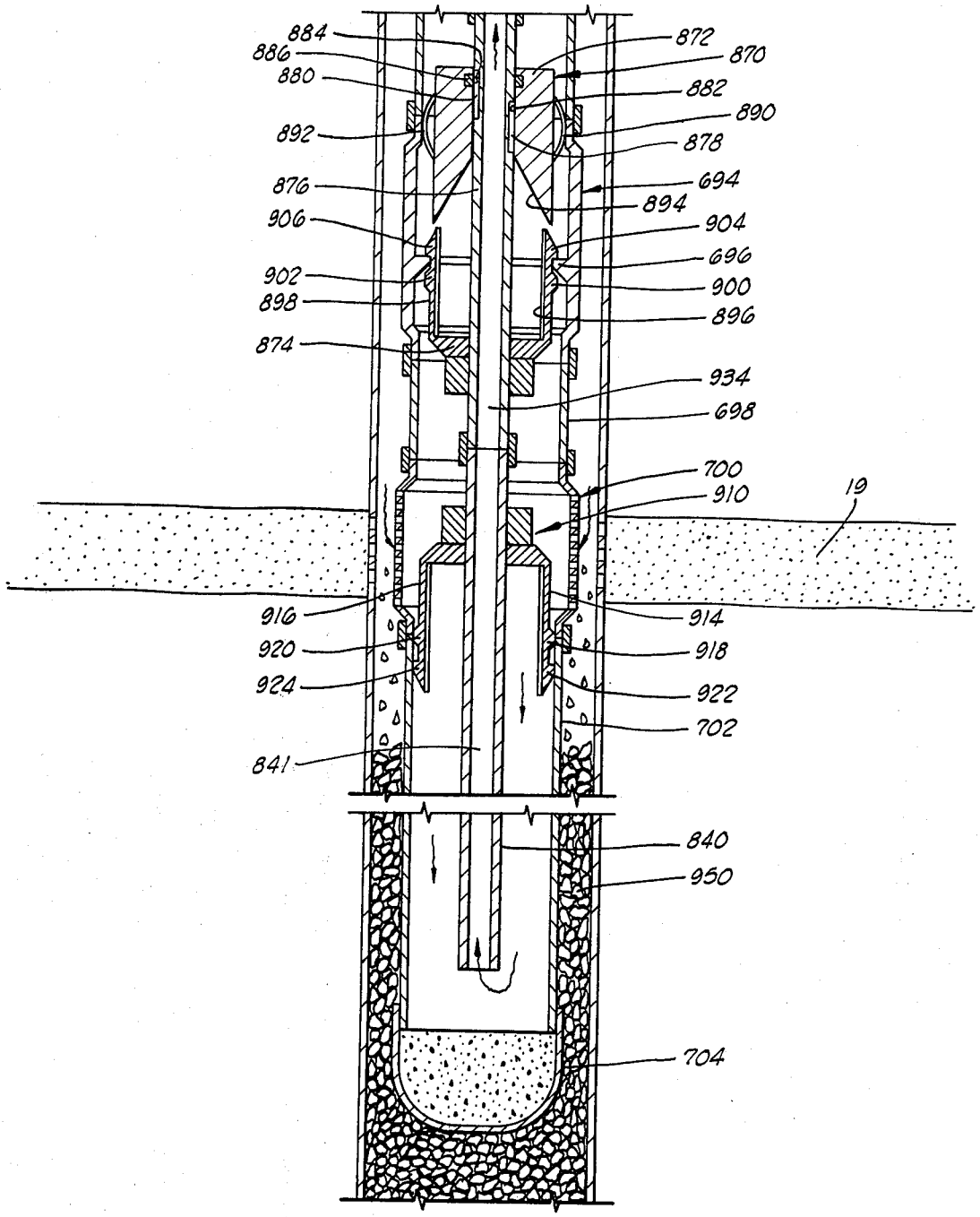
Figure 13:
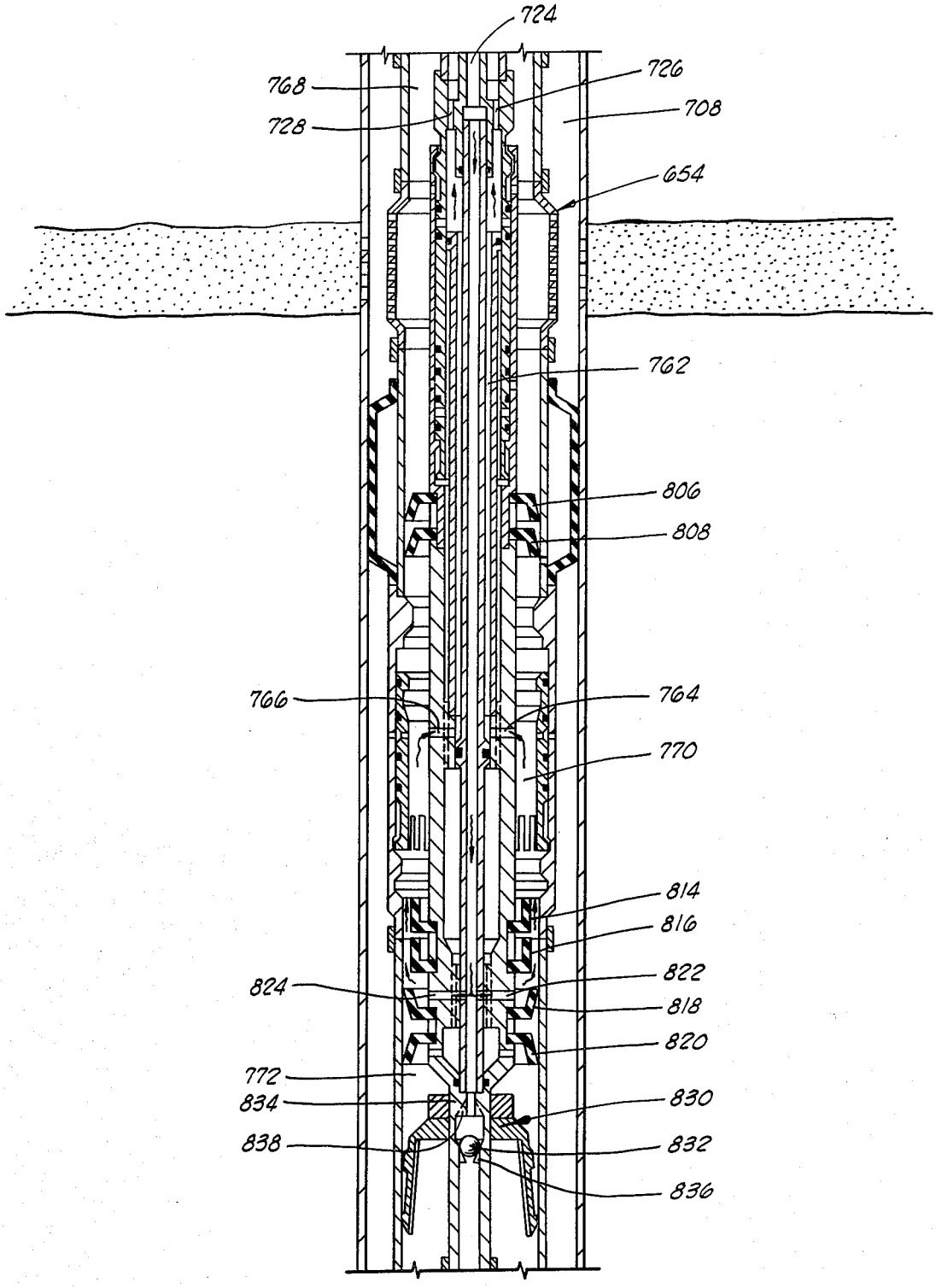

Utilization of crossover tool 28 with the simplified strings of gravel packing apparatus depicted in FIGS. 12 and 13 will be related hereafter, again by way of illustration and not by way of limitation.

A tool string, generally designated by reference character 26, is hung within liner 24 from crossover tool 28 (above FIGS. 12*a*) by inner blank pipe 150 and outer blank pipe 152 which are connected to inner conduit 120 and outer conduit 114, respectively. Disposed about the tool string 26 and liner 24 is casing 22 having perforations therethrough at the levels of two unconsolidated producing formations (unnumbered) through which the well bore passes.

Crossover tool 28 is positioned above liner hanger 600, by which liner 24 is secured within well casing 22, a sufficient distance to enable the tool string 26 to be reciprocated to operate the tools in the string when gravel packing the lowest zone. Liner hanger 600 is positioned in casing 22 by means of slips 606 employed in mechanically setting packer 604. Threaded collar 602 is employed to secure liner 24 to a drill string during its installation in the well bore inside the well casing 22.

Moving downwardly from liner hanger 600, the liner comprises a length of blank pipe (unnumbered) to a location just above the highest zone to be packed. At that point is located a casing inflation packer, illustrated schematically at 610. The annular space defined by mandrel 614 and elastomeric outer wall 612 is inflated by pumping fluid through schematically illustrated check valve 616 to a predetermined pressure.

Below packer 610 is located gravel collar 618, comprising housing 620 within which is slidably disposed sleeve 622. At the top of housing 620 is located necked-down portion 644, bounded by beveled edges. Gravel ports 624 and 626 extend through housing 620. Near the lower end of housing 620 annular shoulder 632 is followed by annular groove 634, cylindrical surface 636 of substantially the same inner diameter as shoulder 632, and annular groove 638. Inside sleeve 622 has disposed thereabout four annular seals (unnumbered). At the top of sleeve 622 is located downward facing annular shoulder 642. Between the upper and lower pairs of annular seals apertures 628 and 630 communicate with gravel ports 624 and 626 when aligned therewith. At the lowest extremity of sleeve 622 are located a ring of collet fingers 640 having radially outward extending lower ends. Below gravel collar 618 is polished nipple 646.

Anchor tool 648 is located below polished nipple 646. Anchor tool 648 possesses upward-facing annular shoulder 650, above and below which are annular recesses.

Below anchor tool 648 is blank pipe 652 and gravel screen 654, disposed across the upper producing formation or zone of interest below blank pipe 652.

Referring to the lower zone of interest, casing inflation packer 656, substantially identical to packer 610, is located below gravel screen 654 to isolate the upper zone of interest from the lower zone. The annular space defined by mandrel 660 and elastomeric outer wall 658 is inflated by pumping fluid through schematically illustrated check valve 662 to a predetermined pressure.

Below packer 656 is located a second open gravel collar 664, substantially identical to gravel collar 618. Gravel collar 664 comprises outer housing 666 within which is slidably disposed sleeve 668. At the top of housing 666 is located necked-down portion 690, bounded by beveled edges. Gravel ports 670 and 672 extend through housing 666. At the lower end of housing 666 is shoulder 678, followed by annular groove 680, cylindrical surface 682 of substantially the same inner diameter as shoulder 678, and annular groove 684. Sleeve 668 possesses four annular seals (unnumbered). At the top of sleeve 668 lies downward facing shoulder 688. Between annular seals the upper and lower pairs of apertures 674 and 676 communicate with gravel ports 670 and 672 when aligned therewith. At the lowest extremity of sleeve 668 are located a ring of collet fingers 686 having radially outward extending lower ends. Below gravel collar 664 is located second polished nipple 692, below which is second anchor tool 694. Anchor tool 694 possesses upward-facing annular shoulder 696, above which are annular recesses.

Gravel screen 700 is disposed across the lower producing formation or zone of interest. Gravel screens 654 and 700 are fore-shortened in the drawings herein, and actually may be a number of feet in length, the length be-being determined by the thickness of the producing formation to be gravel packed, all of which is evident to those skilled in the art, it being further evident that the gravel screens may have perforations, as shown, or may employ wire-wrapped slots to form the desired operations.

Another length of blank pipe 702 is attached below gravel screen 700, and the lowest end of the pipe is capped with a guide shoe 704.

It should be noted that the proper orientation of tool string 26 with respect to liner 24 is dependent upon the polished nipples 646 and 692 being of the appropriate length to position isolation gravel packer and bypass assembly 720 (see FIG. 12C) across either gravel collar 618 or 664 when the tool string 24 is anchored in place at the zone being packed.

The liner 24 having been described in detail, the operating string 26 will now be described from the top thereof downward.

As stated previously, inner conduit 120 and outer conduit 114 of crossover tool 28 mate with inner blank pipe 150 and concentric outer blank pipe 152 which extend downward to isolation gravel packer and bypass assembly 720. Concentric pipes 150 and 152 must be of sufficient length to permit positioning of the isolation gravel packer and bypass assembly 720 (FIG. 1C) across the lowest gravel collar 664, while allowing adequate reciprocal motion of the operating string 26 without the crossover tool 28 impinging on liner hanger 600. As the two lengths of pipe cannot be matched exactly, it is of course necessary to include a fluid-tight slip joint and swivel assembly illustrated in simplified form at 608 in the inner string of pipe.

Referring to FIGS. 12B and 12C, blank pipes 150 and 152 enter the top of isolation gravel packer and bypass assembly 720. At the top end of isolation gravel packer and bypass assembly is located upper body 722, at which point blank pipe 150 communicates with axial circulation passage 724 and the annulus 156 between pipes 150 and 152 communicates with outer passages 726 and 728.

Below outer passages 726 and 728, upper body 722 possesses a constricted area on its exterior upon which is disposed outwardly facing circumferential shoulder 730. Below circumferential shoulder 730 are disposed annular seals 732 and 734, which bracket bypass ports 736 and 738. Continuing downward, annular seals 740, 742, 744 and 746 are disposed about the lower portion of upper body 722. Bypass ports 748 and 750 are located between seals 744 and 746. Slidably disposed about upper body 722 is bypass valve body 752, through which extend bypass ports 754 and 756 at the upper end thereof, and bypass ports 758 and 760 at the lower end thereof. When pipe 20 is moved upward, thereby pulling upper body 722 upward, ports 736 and 738 in upper body 722 become aligned with ports 754 and 756, respectively, in bypass valve body 752. At the same time, bypass ports 758 and 760 become aligned with bypass ports 748 and 750, respectively, in the lower end of the assembly. When the bypass ports are aligned, the upper bypass port sets permit fluid communication between annulus 768 above the isolation gravel packer and packer annulus 770, through inner annular passage 762 and gravel passages 764 and 766, permitting fluid flow and equalization of pressures, thus eliminating swabbing when the tool string 26 is raised or lowered in the well bore. Similarly, the lower bypass port sets allow pressures to be equalized between the annulus 768 above the isolation gravel packer and annulus 772 below, via outer annular passage 774, upper vertical bypass passages 776 and 778, upper annular bypass chamber 780, lower vertical bypass passages 782 and 784, lower annular bypass chamber 786 and lateral bypass passages 788 and 790. In the closed position of the bypasses, a ring of collet fingers 792 at the top of bypass valve body 752 engages shoulder 730 on upper body 722. When in the open position, the inward protrusion at the upper portion of collet fingers 792 abuts the lower edge of shoulder 730 positively holding the bypass open until weight is set down on the operating string 30. Reciprocating motion is limited between bypass valve body 752 and upper body 722 by the abutting of a ring of lugged fingers 794 of the lower end of upper body 722 with the annular shoulder 796 of bypass valve body 752.

Within both bypass valve body 752 and upper body 722 are disposed sleeve 798 and concentric inner mandrel 800. Annular seal 802 provides a fluid seal between sleeve 798 and upper body 722, while annular seal 804 provides a fluid seal between inner mandrel 800 and upper body 722. Seals 802 and 804 both allow reciprocal movement of upper body 722. Disposed about the exterior of the lower portion of bypass valve body 752 are downward-facing packer cups 806 and 808. Below packer cups 806 and 808, lower body 810 possesses lateral gravel passages 764 and 766 which communicate with inner annular passage 762 and are aligned with gravel ports 670 and 672 when the isolation gravel packer and bypass assembly 720 is anchored in place at the lower zone adjacent gravel collar 664. Annular seal 812 isolates inner annular passage 762 from upper annular bypass chamber 780.

At the lowermost end of isolation gravel packer and bypass assembly 720 are mounted upward-facing packer cups 814, 816 and 818, and downward-facing packer cup 820 upon lower body 810. Between packer cups 816 and 818 are located lateral circulation passages 822 and 824, which communicate with axial circulation passage 724. As noted previously, lower vertical bypass passages 782 and 784 avoid lateral circulation passages 822 and 824 and permit fluid communication between upper annular bypass chamber 780 and lower annular bypass chamber 786, which in turn exits through lateral bypass passages 788 and 790 to annulus 772 below downward-facing packer cup 820.

Immediately below isoaltion gravel packer and bypass assembly 720 is ball check valve 830, comprising ball 832, housing 834, and valve seat 836. Bypassess 838 in housing 834 permit fluid flow upward into axial circulation passage 724, from tail pipe 840 but seat 836 halts downward flow when circulation is reversed and ball 832 is formed against it.

At approximately the same location as ball check valve 830 is opening sleeve positioner 844, comprising a sleeve positioner body with spring arms 848 and 850. Each arm possesses a radially outwardly extending shoulder 852 and 854, with beveled edges. At the ends of the spring arms 848 and 850 are located protrusions 856 and 858, each having an upward-facing radially outward extending shoulder at the top thereof, the lower outside face of each protrusion being beveled inwardly in a downward direction. Spring arms 848 and 850 are shown in a slightly compressed position against the interior of liner 24 at polished nipple 692.

Below opening sleeve positioner 844 in operating string 24 is located anchor positioner 870. Anchor positioner 870 comprises drag block assembly 872 and spring arm collar 874. Drag block assembly 872 is slidably mounted on mandrel 876, in which are located slots 878 and 880. Pin 882 is fixed to drag block assembly 872, and slides axially within slot 878. Pin 882 is mounted in ring 886 which encircles mandrel 876 and is rotationally slidably housed in an annular groove in drag block assembly 872. The ring-pin combination permits pin 884 to move circumferentially as well as axially, following the edges of slot 880, which is a complex slot in the fashion of slot 88 in crossover tool 28. However, slot 880 is an inverted mirror-image version of slot 88, without the elongated axial portion (as where pin position **78*d* is shown in FIG. 4B). Drag block assembly 872 may then be selectively reciprocated up and down on mandrel 876, as will be explained in greater detail hereafter. On the exterior of drag block assembly 872 are spring-loaded drag blocks 890 and 892, shown schematically, which press against the inside of liner 24, thus centering the anchor positioner 870. The lower face 894 of drag block assembly 872 is frusto-conical in configuration, being inclined inwardly and upwardly from the lowest extremity thereof. Below drag block assembly 872, spring arm collar 874 possesses upward-facing spring arms 896 and 898, similar to those of opening sleeve positioner 844. Spring arms 896 and 898 possess radially outward extending shoulders 900 and 902, as well as protrusions 904 and 906 at their upper ends. The shoulders have beveled edges, and the protrusions have downward-facing radially outward extending shoulders at the bottom, and upwardly extending inwardly-beveled faces at the top. The uppermost points of these faces are disposed on a radius less than the lowermost extremity of drag block assembly 872, thus permitting the inclined face 894 to slidably engage and compress the spring arms 896 and 898 when operating string 24 is pulled upward. By virtue of complex slot 880 in combination with pin 884 and ring 886, drag block assembly 872** may be locked in this position, referred to as the "retract" mode.

Below anchor positioner 870 is located closing sleeve positioner 910, comprising a positioner body on which are mounted downward-facing spring arms 914 and 916. Each spring arm 914 and 916 possesses outward radially extending shoulders 918 and 920, the edges of which are beveled. At the lowest end of the spring arms are located protrusions 922 and 924 having upward-facing outwardly radially extending shoulders at their upper edges, and downward inwardly beveled edges on their lowermost exteriors. Spring arms 914 and 916 are shown in slightly compressed positions against the interior of screen liner assembly 24 at blank end pipe 702.

At the lowest extremity of operating string 30 is tail pipe 840, having bore 841 which communicates with bore 934 extending through anchor positioner mandrel 876 up to check valve 830.

The complete tool string 24 having been described, its operation is reviewed below. After the well is drilled and casing 22 inserted it is perforated at the appropriate intervals adjacent the producing formations, washed and possibly treated in some manner. At this point, liner 24 is lowered in the well bore and hung within casing 22 by liner hanger assembly 600.

The liner 24 as installed in the casing, comprises as many gravel collars as there are zones to be packed, as shown in the present instance by reference characters 618 and 664. As stated previously, the gravel collars 618 and 644 are located above their respective zones to be packed, while corresponding gravel screens 654 and 700 are located adjacent to and spanning these zones. Between each gravel collar and its corresponding gravel screen are located polished nipples 646 and 692, and anchor tools 648 and 694, respectively, which accurately position the tool string 26 at each zone when the anchor positioner assembly 870 is engaged in the appropriate anchor tool.

Above the upper zone is located suitable casing inflation packer 610, and below the zone is suitable casing inflation packer 656, which, when inflated isolate the upper zone from the zone below and the well annulus above. If the upper zone is extremely close to liner hanger assembly 600, packer 610 may be deleted as redundant when a liner hanger with a sealing element is employed such as illustrated schematically at 604. If it is desired to isolate zones not only from each other but from the intervals between formations, packers may be employed above and below each zone. For example, if the upper zone in the present instance was far above the lower zone, an additional casing inflation packer might be utilized in the liner 24 above packer 656 and yet below the upper zone.

After the liner 24 is hung in the casing, the operating string 24 is run into the well bore. The operator has the option of inflating casing inflation packers 610 and 656 as the tool string 28 is going down the well bore, or he may elect to inflate the packers from the bottom as he proceeds upward. He may, in fact, inflate the packers in any order but for purposes of discussion the methods of inflating packers from the bottom up will be more fully described hereinafter, with particular reference to FIGS. 1C and 1D.

With anchor positioner 870 in its retract mode (face 894 of drag block assembly 872 comprising spring arms 896 and 898 inwardly), tool string 26 is lowered to the approximate location of the lowest zone and anchor tool 694. The tool string 26 is then reciprocated upward and then downward to effect the release mode, anchor positioner 870 being lowered further to engage anchor tool 694. If the anchor positioner 870 happens to be released below anchor tool 694, it may be raised through it even in the release mode, as the inclined outer edges of protrusions 904 and 906 will guide spring arms 896 and 898 past shoulder 696 of anchor tool 694. Anchor positioner 870 is locked in position in the anchor tool by the outward bias of spring arms 896 and 898 when downward-facing shoulders on protursions 904 and 906 are resting on shoulder 696. At this point, unlike FIG. 12, gravel collar 664 will be closed (as shown by collar 618 in FIG. 12B), as no steps have yet been taken to open it. Thus, inflation port 662 of casing inflation packer 656 is spanned by downward-facing packer cups 806 and 808 and upward-facing packer cups 814 and 816 of isolation gravel packer and bypass assembly 720. As the packer cannot be inflated while the bypass ports in isolation gravel packer and bypass assembly 720 are open, it is necessary to set approximately 20,000 pounds of weight on the anchor to close them. When the weight is set, upper body 722 moves downwardly with respect to bypass valve body 752, to the position shown in FIG. 12C, isolating ports 754, 756, 758 and 760 in bypass valve body 752 from ports 736, 738, 748 and 750, respectively, in upper body 722, annular seals 732, 734, 740, 742, 744 and 746 preventing fluid movement between annulus 768, and packer annulus 770 and annulus 772 below isolation gravel packer and bypass assembly 720. As crossover tool 28 (see FIG. 1) will be in the open mode annular seals 68 and 70 isolate tool bypasses 116 and 118, cutting off fluid communication between annulus 16 and annulus 18 (which communicates with annulus 768 inside liner 24). However, should crossover tool 28 be in its closed test mode (FIG. 2), or closed bypass mode (FIG. 3), inflation may still proceed even with bypass ports 116 and 118 open. All necessary ports being closed, the tool string 26 is then pressured to the desired pressure through pipe 20 to inflate casing inflation packer 656. The pressurized fluid reaches packer 656 through mandrel bore 122, annular crossover passage 126, blank pipe annulus 156, outer passages 726 and 728, inner annular passage 762, then gravel passages 764 and 766 which exit into packer annulus 770 defined by the interior of liner 24, the exterior of isolating gravel packer and bypass assembly 720, packer cups 806 and 808 at the top, and 814 and 816 at the bottom. From packer annulus 770, fluid enters casing inflation packer 656 through check valve 662, inflating it to a predetermined pressure. The casing inflation packer being inflated, gavel packing may now proceed at the lowest zone as described hereafter.

Full open gravel collar 664 is opened by reciprocating tool string 26 to retract the anchor positioner 870, and raising the tool string 26 so that opening sleeve positioner 884 engages sleeve 668 of full open gravel collar 664. Spring arms 848 and 850 of opening positioner 844 expand and the shoulders on protrusions 856 and 858 engage annular shoulder 866 on sleeve 844. A pull of approximately 10,000 pounds will align apertures 674 and 676 of sleeve 668 with gravel ports 670 and 672 of housing 666, thereby opening the gravel collar 664. As the open position of full open gravel collar 664 is reached, collet fingers 680 move from annular groove 684 over cylindrical surface 682 and snap into annular groove 680, while radially outward extending shoulders 852 and 854 have contacted the beveled edge leading to necked-down portion 690 of gravel collar 664, which contact compresses spring arms 848 and 850, causing them to release from sleeve 844, leaving gravel collar 664 in the open position. The tool string 26 is then lowered to the approximate location of the anchor 694, then picked up again to release the anchor positioner 870, and lowered until the anchor positioner 870 is locked in anchor 694.

At this point, gravel packing may begin, provided that the crossover tool is in the proper position. Crossover tool 28 is also operated by up and down, or reciprocating, motion, as previously described. However, the force required to index the crossover tool 28 from one mode to another is less than that required to index the anchor positioner 870. As the crossover is indexed when the anchor positioner 870 is set in an anchor tool, there is a constraint against upward motion, thereby permitting proper indexing of the crossover tool 28. To ascertain if crossover tool 28 is in the open mode, whereby circulation passage 106 in body 84 communicates with circulation ports 74 and 76 in outer sleeve 30, sufficient weight is set down to close tool bypasses 116 and 118 if crossover tool 28 is in the closed bypass mode, and the operator pressures down annulus 16. If the crossover tool 28 is open, fluid will circulate into circulation passage 106, down inner conduit 120 to inner blank pipe 150, axial circulation passage 724, out lateral circulation passages 822 and 824, past upward-facing packer cups 814 and 816 to packer annulus 370, back through gravel passages 764 and 766, inner annular passage 762 and back to the surface through blank pipe annulus 156, annular crossover passage 126 to bore 122 and pipe 20. If crossover tool 28 is in the closed test mode there will be an immediate increase in pressure when pressuring annulus 16, as there is no circulation possible, passage 106 being closed off as well as tool bypasses 116 and 118, packer cups 138 and 144 holding a seal between the crossover tool 28 and casing 22. If in the closed test mode, upward and then downward reciprocation, with substantial weight being set down, will open crossover tool 28.

Assuming that the operator now has crossover tool 28 in its open mode, gravel packing may now be effected. A slurry of carrier fluid containing gravel is pumped down pipe bore 20 and into bore 122 of crossover tool 28 past circulation block 108 into annular crossover passage 126, blank pipe annulus 156 into passages 726 and 728, inner annular passage 762 and out through gravel passages 764 and 766 into packer annulus 770, then through gravel ports 670 and 672, of previously opened gravel collar 664 into the lower zone annulus 710, where the gravel is deposited. The carrier fluid returns into liner 24 through gravel screen 700, the gravel 950 being retained on the outside of the screen 700 by virtue of the proper sizing of the apertures thereof. The gravel-free carrier fluid then enters tail pipe bore 841, anchor positioner mandrel bore 934, and returns past ball check valve 830 which is unseated by fluid passing in an upward direction. The fluid then proceeds through axial circulation passage in isolation gravel packer and bypass assembly 720, then up through inner blank pipe 150 to axial crossover passage 124, through circulation passage 106 and circulation ports 74 and 76, respectively, into annulus 16, then to the surface. The circulation path in the zone is designated by the arrows shown in FIGS. 12C and 12D. Circulation of the gravel slurry is continued to build up a gravel pack from below gravel screen 700 to a point above it, thus interposing a barrier to sand migration from the zone into the liner 24. When pressure resistance is noted at the surface, this indicates that gravel in the lower zone has been deposited (packed) higher than the top of gravel screen 700, and the pack has been completed. It is evident that no fluid movement has been induced across the upper zone, during packing, as both gravel slurry and returns are contained within the tool string 24.

If desired at this point, the gravel pack may be further consolidated by applying pressure to it, referred to as squeezing. To effect this, crossover tool 28 is reciprocated up and then down to effect the closed test mode, and pressure applied down the drill pipe 20. This pressure will act upon the pack through the same circulation path as described previously. Fluid is contained below isolation gravel packer and bypass assembly 720 by downward-facing packer cup 820, as during normal circulation with crossover tool 28 open. In order to clear the interior of the operating string 30 of the residue after squeezing, circulation is then reversed using a clean fluid. This operation is illustrated in FIG. 13. No movement in the well bore is required to effect this operation, the only action on the part of the operator being necessary is an upward and downward reciprocation of the drill pipe 20 to reopen crossover tool 28 if a squeeze has been applied to the pack. Clean fluid is sent down annulus 16, through circulation ports 74 and 76, circulation passage 106, and down annular crossover passage 124 through blank pipe 150 to axial circulation passage 724 in isolation gravel packer and bypass assembly 720. When the fluid reaches check valve 830, ball 832 is seated on valve seat 836 preventing flow downward. At this point, the clean fluid will then exit isolation gravel packer and bypass assembly 720 through lateral circulation passages 822 and 824, and flow upward past collapsed packer cups 814 and 816, and back through gravel passages 764 and 766 into inner annular passage 762, through outer passages 722 and 724 to blank pipe annulus 156 through annular crossover passage 126, past circulation block 106 and mandrel bore 122 to the surface through the bore of drill pipe 20. When clean fluid is returned to the surface, the packing job is complete. The circulation path in the area of the zone is designated by the arrows in FIG. 13. It is noteworthy that the reversing fluid is prevented from circulating below isolation gravel packer and bypass assembly 720 by upward-facing packer cup 818, responsive to the pressure of fluid flow through lateral circulation passages 822 and 824, and as a result of this seal as well as the closing of check valve 830, reverse circulation is effected without fluid movement across the zone just packed.

At this point, the operating string may be moved upward to the next zone of interest, in this case between casing inflation packers 610 and 656. The tool string 26 is reciprocated upward, thus retracting the anchor positioner 870 and disengaging anchor tool 694. As the tool string 26 is pulled up to the next zone, the passing spring arms 914 and 916 of closing sleeve positioner 910 pulls sleeve 668 of full open gravel collar 664 upward. The upward facing outwardly radially extending shoulders of protrusions 922 and 924 on spring arms 914 and 916 engage downward facing annular shoulder 688 in sleeve 668. As the operating string is pulled up, the spring arms 914 and 916 close gravel collar 664, at which point collet fingers 680 have been raised above annular shoulder 678 and shoulders 918 and 920 encounter necked-down portion 690 of gravel collar 664, which compresses spring arms 914 and 916, releasing them from shoulder 688 of sleeve 664. The lower two annular seals now bracket gravel ports 670 and 672, sealing them. The tool string 26 is then pulled up to the next zone, where it is reciprocated downward briefly, and then upward again, and lowered downward into anchor tool 648. If the casing inflation packer 610 above the upper zone has been previously inflated, the final upward reciprocation can effect the opening of gravel collar 618, by engaging shoulder 642 of sleeve 622 with spring arms 848 and 850 of opening sleeve positioner 844. As noted previously, when spring arms 848 and 850 have opened the collar 618 by pulling sleeve 622 upward, they will automatically disengage as shoulders 852 and 854 encounter necked-down portion 644 which will in turn compress spring arms 848 and 850. If packer 610 has not been previously inflated then the opening of gravel collar 618 must succeed this operation, performed in the same manner as set forth above with respect to packer 656.

When the anchor positioner 870 has engaged anchor 648, gravel packing may proceed at this zone in the same manner as in the lower zone. Crossover tool 28 must, of course, be in the open position, which may be ascertained as previously noted herein. After packing of the upper zone of interest is effected, the tool string 26 is withdrawn and the well may be produced.

DESCRIPTION OF A FIRST ALTERNATIVE EMBODIMENT

Referring to the drawings, and FIGS. 6 through 9 in particular, alternative crossover tool 228 depends from drill pipe 20 disposed in casing 22. Crossover tool 228 comprises body 284 about which is slidably disposed sleeve 230, attached to drill pipe 20 running to the surface.

Outer sleeve 230 is assembled from individual sections. Adapter sleeve 232, by which crossover tool 228 (and the tool string below it, which may be the same as that described previously with reference to FIGS. 12 and 13) is hung, threadably engages upper collet sleeve 236, a fluid seal being achieved therebetween by O-ring 234. Upper collet sleeve 236 is in turn threadably attached to lower collet sleeve 242, with O-ring 240 being interposed. The lower end of lower collet sleeve 242 is attached to circulation port housing 246, below which is seal sleeve 248, and end cap 254. The junction of adapter sleeve 232 and upper collet sleeve 236 creates annular housing 256, in which is rotationally slidably disposed ring 280 carrying pin 278. Pin 282 is fixed to adapter sleeve 232 in a position above ring housing 256. Below housing 256, upper collet sleeve 236 possesses an enlarged bore for a substantial distance, below which the bore is further enlarged to create the upper portion of snap-ring annulus 260. The junction of upper collect sleeve 236 and lower collet sleeve 242 creates annular snap-ring housing 262, below which the bore of lower collet sleeve 242, corresponding in inner diameter to that of upper collet sleeve 236 above snap-ring housing 262, forms the lower portion of snap-ring annulus 260.

Annular seal 266 is housed at the junction of lower collet sleeve 242 and circulation port housing 246, annular seal 268 being housed at the junction of the latter seal sleeve 248. Circulation ports 274 and 276 are disposed between annular seals 266 and 268, extending through the wall of sleeve 230 at circulation port housing 246. Annular seal 270 is contained in the housing formed at the joinder of seal sleeve 248 and end cap 254. Mandrel 286 is substantially tubular, with bore 322 running uninterrupted to circulation block 308. Circumferentially spaced slots 288 and 290 are machined on the outer surface of mandrel 286; developments of slots 290 and 288 are shown in FIGS. 8A and 8B. Axially below the slots, upper sleeve bypasses 292 and 294 extend from the bore to the outer surface of mandrel 286. Immediately below upper sleeve bypasses 292 and 294 commences upper sleeve bypass annulus 258 (which is variable in length, as will be explained hereafter), defined primarily by the bore wall of upper collet sleeve 236 and the outer surface of mandrel 286. Surrounding and threadably attached to mandrel 286 below the upper sleeve bypasses is collet skirt 296, having collet 298 at the lower end thereof, collet 298 having a radially inwardly tapered lower surface communicating with the outer surface of mandrel 286, a uniform flat median surface, and a radially inward extending upper shoulder communicating with the cylindrical upper portion of collet skirt 296. Wiper ring 238, housed in upper collet sleeve 236, is in slidable wiping contact with collet skirt 296 above collet 298. Below collet skirt 298, the outer diameter of mandrel 286 is increased slightly, this surface extending to lower sleeve bypasses 302 and 304, which bypasses extend between the bore and the outer surface of mandrel 286. As with crossover tool 28, the outer diameter of cylindrical upper portion of collet skirt 296 is greater than that of mandrel 286 below collet 298. Snap-ring 300 will slide substantially freely on mandrel 286, but will slide with substantial friction on collet skirt 296. Wiper ring 244, housed in lower collet sleeve 242, is in slidable wiping contact with the outer surface mandrel 286 below collet skirt 296. Commencing proximate the axially upper extent of lower sleeve bypasses 302 and 304, and continuing axially downward to a point near annular seal 266, mandrel 286 is of reduced outer diameter, forming variable length lower sleeve bypass annulus 264 in conjunction with the bore wall of lower collet sleeve 242, which lower sleeve bypass annulus 264 is in communication with lower sleeve bypasses 302 and 304. Circulation block 308 containing "tee" shaped circulation passage 306 is welded to the bore wall of mandrel 286 in juxtaposition with apertures 310 and 312, circulation block 308 being spaced from the bore wall of mandrel 286 on either side of circulation passage 306 so as to permit fluid flow thereby from bore 322 to annular crossover passage 326. Inner conduit 320, defining axial crossover passage 324, is fixed to circulation block 308 in communication with circulation passage 306. Outer conduit 314 is fixed to mandrel 286 above tool bypasses 316 and 318, which extend between the outer surface of mandrel 286 and tool bypass annulus 328.

Packer cups 338 and 344 are mounted on collars 340 and 346, respectively, and disposed about packer mandrel 334, O-rings 342 and 348 forming a fluid-tight seal therebetween. Collar 346 abuts the enlarged lower end of packer mandrel 334, and is axially spaced from collar 340 by collar sleeve 136. Crossover adapter 332, attached to both packer mandrel 334 and mandrel 286, axially constrain collars 340 and 346 and collar sleeve 336.

Inner blank pipe 150 is attached to inner conduit 320, axial crossover passage 324 thus communicating with blank pipe bore 154 and outer blank pipe 152 is attached to outer conduit 314, blank pipe annulus 156 thus communicating with annular crossover passage 326.

Unlike crossover tool 28, crossover tool 228 only has two modes of operation, open and closed. The open mode is shown in FIG. 6, wherein circulation passage 306 is opened to annulus 16 and tool bypasses 316 and 318 are closed by annular seals 268 and 270. The closed mode is illustrated in FIG. 7, wherein annular seals 268 and 270 isolate circulation passage 306 from annulus 16, and tool bypasses 316 and 318 are open, permitting communication between annulus 16 and annulus 18. The ring and pin combination is substantially the same as in crossover tool 28, as FIG. 9, a section through line x—x of FIG. 6A, shows.

Crossover tool 228 is indexed from the open to the closed mode in the same fashion as tool 28, however, as it has only three annular seals rather than four, there is no closed "test" mode. Thus ascertaining the open or closed mode of the tool may still be effected, as will be described hereafter, but in so doing fluid may be circulated across the zone to be treated prior to treatment.

Figure 6A:
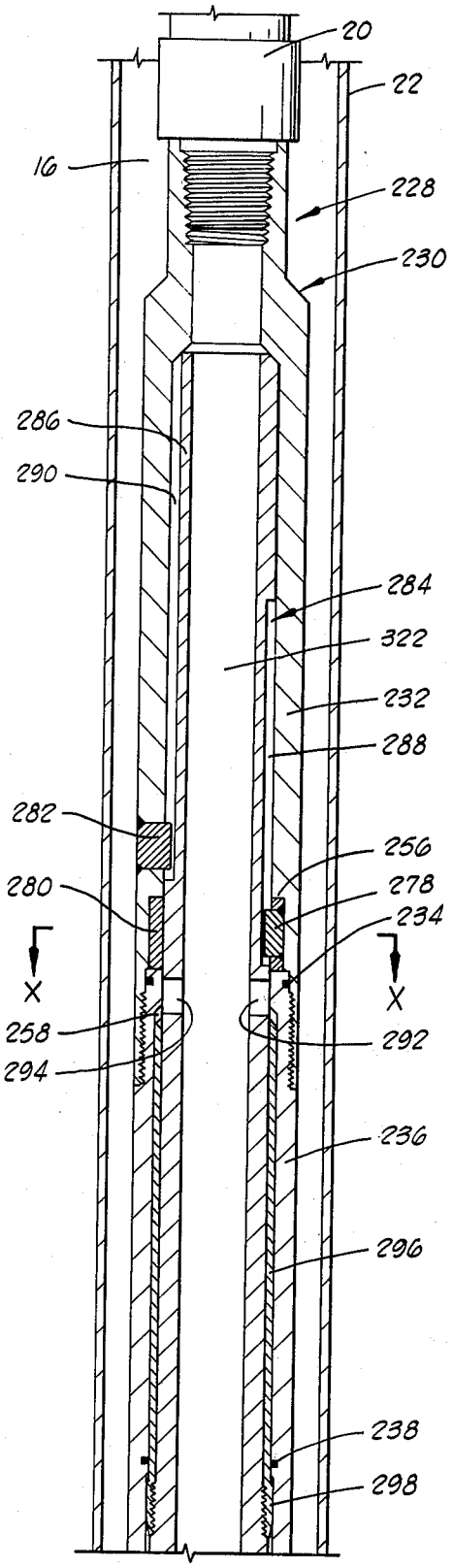
Figure 6B:
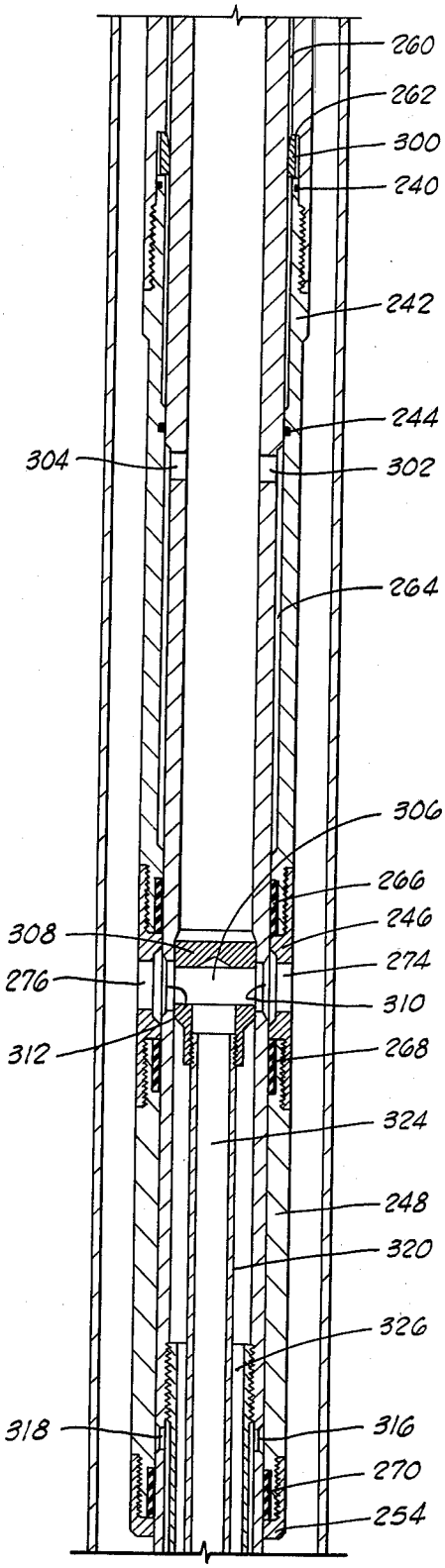
Figure 7A:
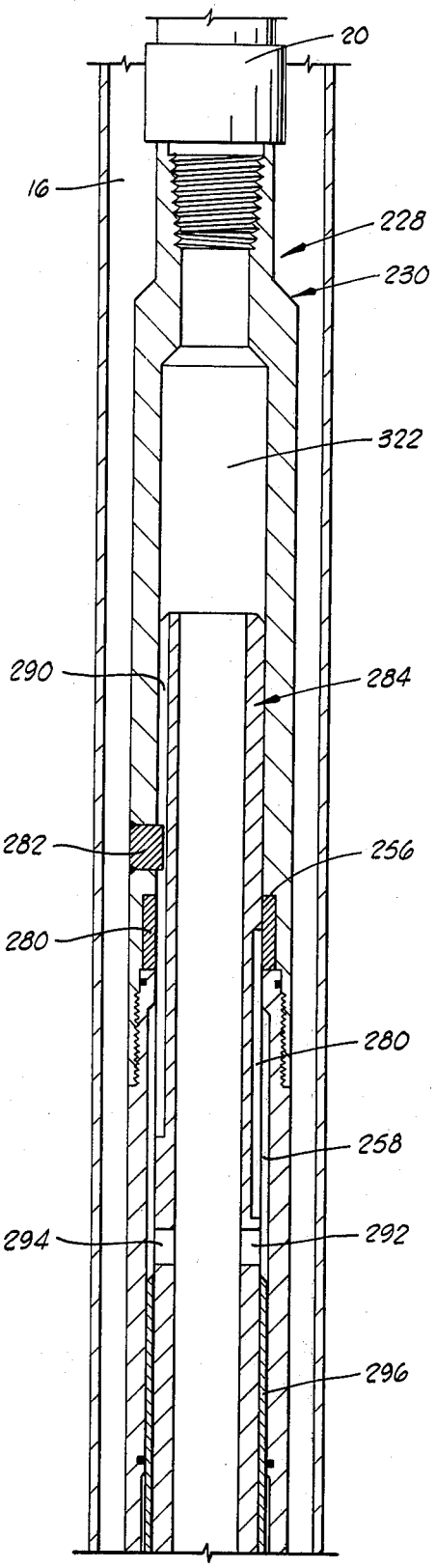
FIGS. 7A, 7B and 7C provide a vertical cross-sectional elevation of the alternative embodiment of the crossover tool in the closed mode.
Figure 7B:
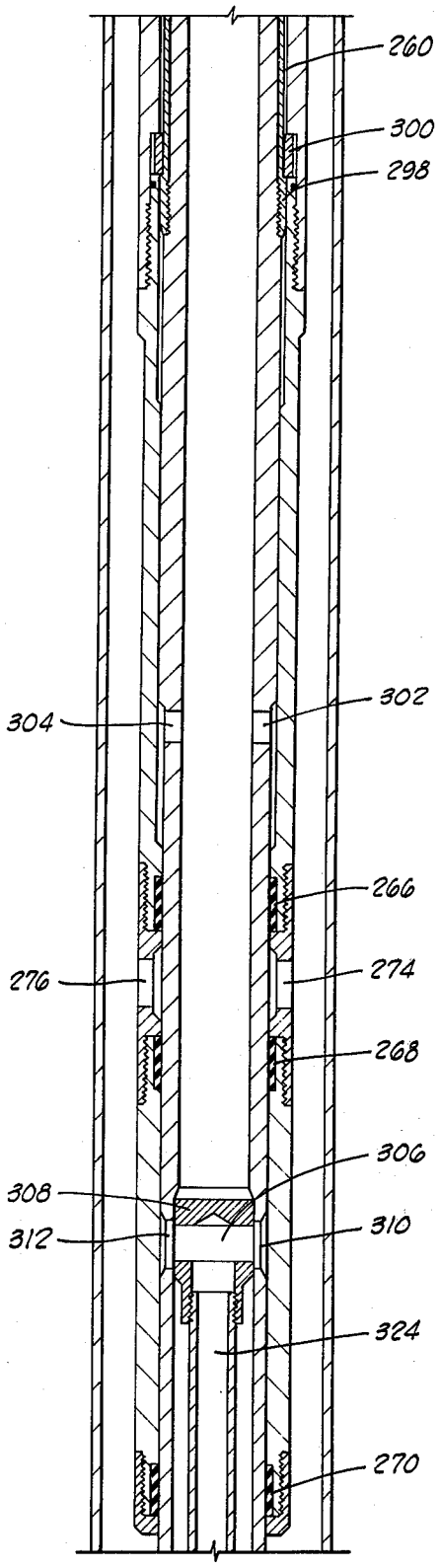
Figure 7C:
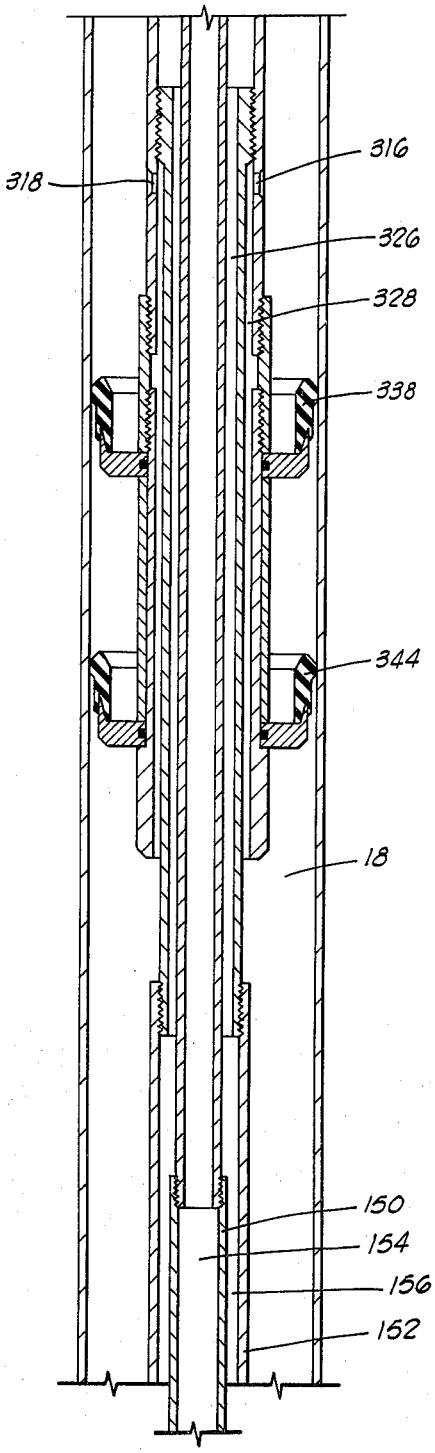

Referring to FIGS. 6A and 6B, it is apparent that pin positions 278*a* and 282 correspond to FIG. 6, crossover tool 228 being in the open mode. Upon upward reciprocation of drill pipe 20, pin 278 is guided to position 278*b* in slot recess 288*a* by angled edges 289*a* of an island 289 and 286*a* of mandrel 286. Downward reciprocation of drill pipe 20 moves pin 278, guided by edge 289*b*, to position 278*c* in slot recess 288*b*. The crossover tool is now in the closed position as shown in FIG. 7, tool bypasses 316 and 318 being open. Subsequent upward reciprocation will take pin 278 to position 278*d*, guided by edge 286*b*. It will be noted that, from position 278*b* to position 278*d*, snap-ring 300 has been raised over collet 298 and is frictionally sliding on collet skirt 296. Thus, when pin 278 reaches position 278*d*, the sleeve will remain raised with respect to body 84 until substantial weight is set down. This has the desired effect of assuring that tool bypasses 316 and 318 will always be open during movement of tool string 26 in the liner 24 as closing the tool bypasses will not be effected until the tool string 26 is employed or about to be employed in a treating operation and thus is fixed in the well bore. Pin 282 follows the axial component of the movement of pin 278, thus following it to positions 282*c* and 282*b*. Downward movement of drill pipe 20 coupled with setting down of weight moves pin 278 back to position 278*a*, being prevented from rotating to 278*c* by edge 289*c*. Pin 282 follows accordingly to 282*a*. In comparing slots 288 and 88, it will be seen that the recess 88*a* is axially more pronounced than recess 288*a*. This is to permit sufficient axial travel for sleeve 30 to assure that tool bypasses 116 and 118 wil be opened at position 78*b*, this feature being unnecessary in crossover tool 228 as the tool bypasses 316 and 318 will be opened at any sleeve position axially higher than 278*c*. If it is desired to make crossover tool 28 function the same as 228, the area below line Z (FIG. 4B) can be milled off of mandrel 86, giving the same mode pattern as the closed test mode of crossover tool 28 will be eliminated.

In use with a tool string, such as tool string 26 shown in FIGS. 12 and 13, operation of crossover tool 228 with respect to circulation and reverse circulation is as described with respect to crossover tool 28, all tool modes being effected by drill pipe reciprocation. When testing to ascertain if tool 228 is in the closed mode, however, the tool string is pressured down the drill pipe. If crossover tool 228 is open, circulation will result. If it is closed, a pressure buildup will be noted; however, care must be taken to avoid overpressuring the area of the zone to be treated to avoid damage, an unnecessary prevention in mode testing crossover tool 28. As with crossover tool 28, it is obvious that the zones above the lowest are again undisturbed during treating due to the positioning of the crossover tool at the top of the concentric tubing strings.

DESCRIPTION OF A SECOND ALTERNATIVE EMBODIMENT

Figure 10A:
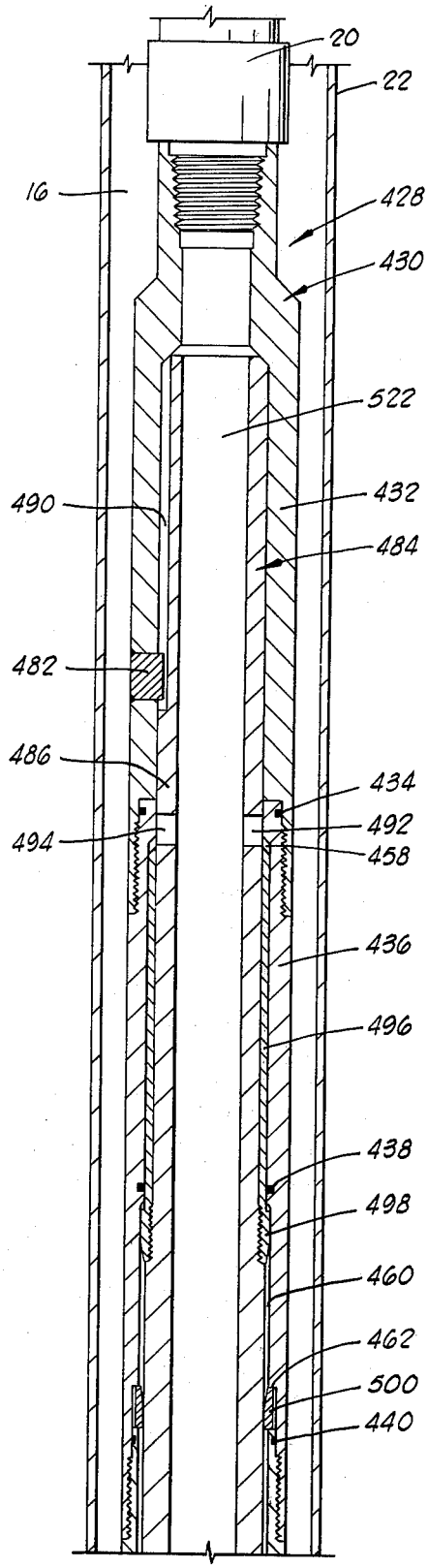
FIGS. 10A and 10B provide a vertical cross-sectional elevation of a second alternative embodiment of the present invention in its circulate mode.
Figure 10B:
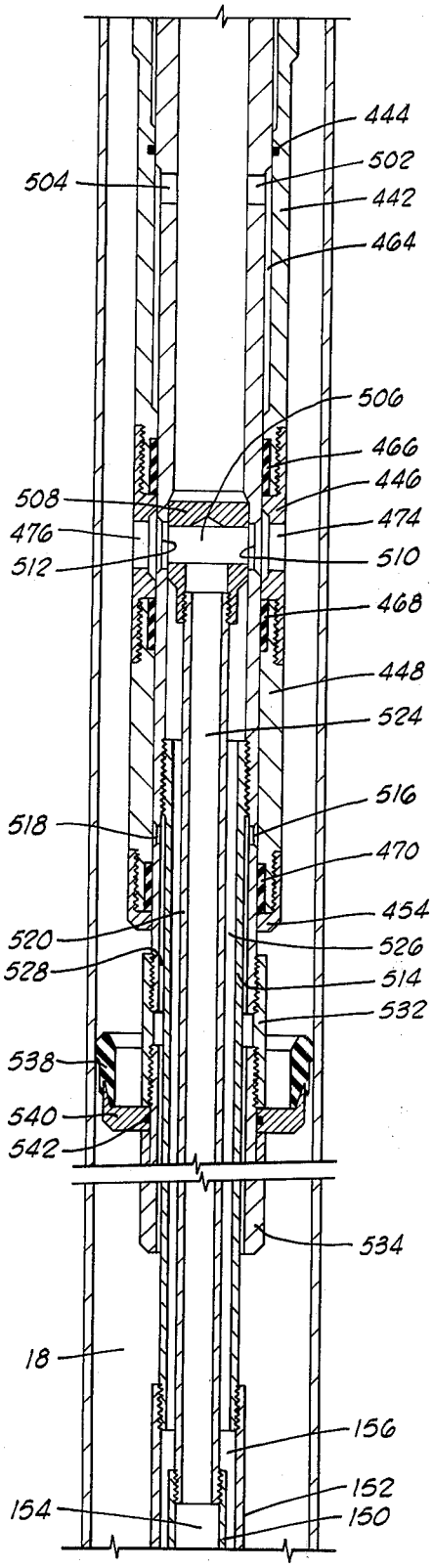
Figure 11A:
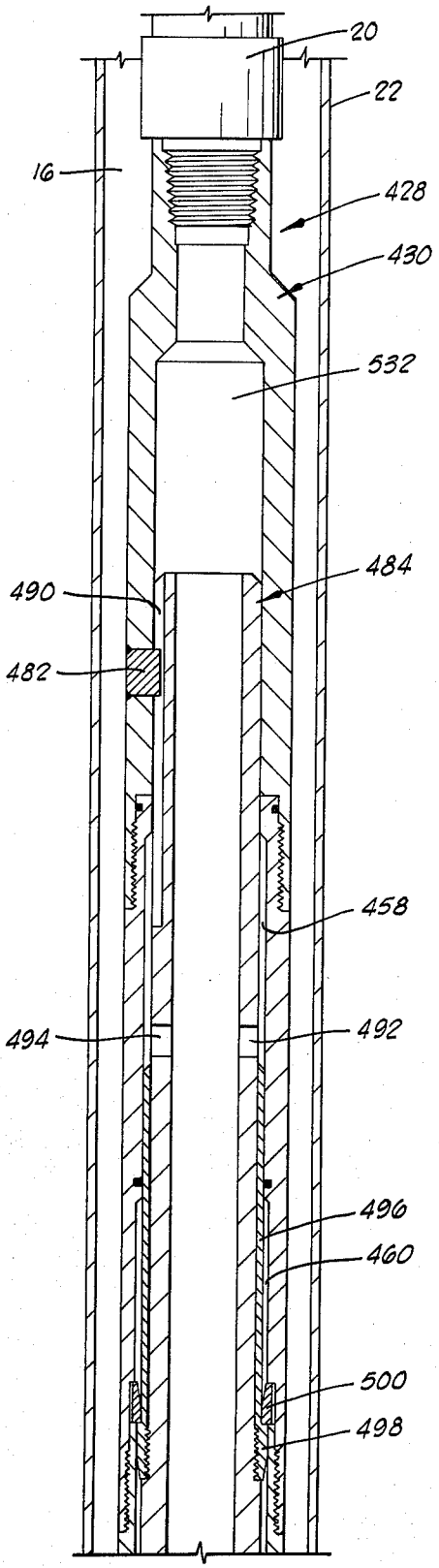
FIGS. 11A and 11B provide a vertical cross-sectional elevation of the second alternative embodiment of the crossover tool in its closed mode.
Figure 11B:
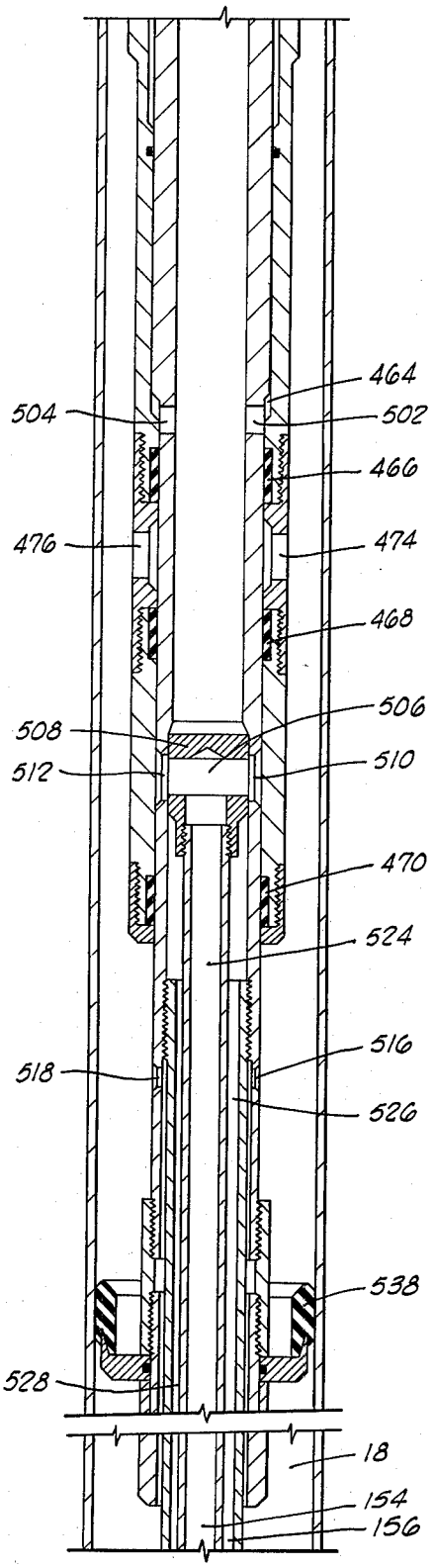

Referring to the drawings, and FIGS. 10 and 11 in particular, crossover tool 428 depends from drill pipe 20, disposed in casing 22. Crossover tool 428 comprises body 484 about which is slidably disposed sleeve 430, attached to drill pipe 20 running to the surface.

Outer sleeve 430 is assembled from individual sections as with crossover tools 28 and 228. Adapter sleeve 432, by which crossover tool 428 (and the tool string below it) is hung, threadably engages upper collet sleeve 436, a fluid seal being achieved therebetween by O-ring 434. Upper collet sleeve is in turn threadably attached to lower collet sleeve 442, with O-ring 440 being interposed. The lower end of lower collet sleeve 442 is attached to circulation port housing 446, below which is seal sleeve 448, and end cap 454. Pin 482 is fixed to adapter sleeve 432. Upper collet sleeve 436 possesses an enlarged bore for a substantial distance, below which the bore is further enlarged to create the upper portion of snap-ring annulus 460. The junction of upper collet sleeve 436 and lower collet sleeve 442 creates annular snap-ring housing 462, below which the bore of lower collet sleeve 442, corresponding in inner diameter to that of upper collet sleeve 436 above snap-ring housing 462, forms the lower portion of snap-ring annulus 460.

Annular seal 466 is housed at the junction of lower collet sleeve 442 and circulation port housing 446, annular seal 468 being housed at the junction of the latter seal sleeve 448. Annular seal 470 is constrained between seal sleeve 448 and end cap 454. Mandrel 486 is substantially tubular, with bore 522 running uninterrupted to circulation block 508. Axial slot 490 is machined on the outer surface of mandrel 486. Axially below slot 490, upper sleeve bypasses 492 and 494 extend from the bore to the outer surface of mandrel 486. Immediately below upper sleeve bypasses 492 and 494 commences variable length upper sleeve bypass annulus 458 defined primarily by the bore wall of upper collet sleeve 436 and the outer surface of mandrel 486. Surrounding and threadably attached to mandrel 486 below the upper sleeve bypasses is collet skirt 496, having collet 498 at the lower end thereof, collet 498 having a radially inwardly tapered lower surface communicating with the outer surface of mandrel 486, a uniform flat median surface, and a radially inward extending upper shoulder communicating with the cylindrical upper portion of collet skirt 496. Wiper ring 438, housed in upper collet sleeve 436, is in slidable wiping contact with collet skirt 496 above collet 498. Below collet skirt 498, the outer diameter of mandrel 486 is increased slightly, this surface extending to lower sleeve bypasses 502 and 504, which bypasses extend between the bore and the outer surface of mandrel 486. The outer surface of collet skirt 496 above collet 498, being of greater diameter than that of mandrel 486 below it, frictionally engages snap-ring 500 after it is raised over collet 498, so as to require a substantial force or weight to move sleeve 430 back to its lowest position. Wiper ring 444, housed in lower collet sleeve 442, is in slidable wiping contact with the outer surface body 484 below collet skirt 496. Commencing proximate the axially upper extent of lower sleeve bypasses 502 and 504, and continuing axially downward to a point near annular seal 466, mandrel 486 is of reduced outer diameter, forming variable length lower sleeve bypass annulus 646 in conjunction with the bore wall of lower collet sleeve 442, which lower sleeve bypass annulus 464 is in communication with lower sleeve bypasses 502 and 504. Circulation block 508 containing "tee" shaped circulation passage 506 is welded to the bore wall of mandrel 486 in juxtaposition with apertures 510 and 512, circulation block 508 being spaced from the bore wall of mandrel 486 on either side of circulation passage 506 so as to permit fluid flow thereby from bore 522 to annular crossover passage 526. Inner conduit 520, defining axial crossover passage 524, is fixed to circulation block 508 in communication with circulation passage 506. Outer conduit 514 is fixed to mandrel 486 above tool bypasses 516 and 518, which extend between the outer surface of mandrel 486 and tool bypass annulus 528.

Packer cup 538 (as well as another, not shown) is mounted on collar 540 and disposed about packer mandrel 534, O-ring 542 forming a fluid-tight seal therebetween. Packer collar 540 is axially spaced from the lower packer cup, as in crossover tools 28 and 228, and is constrained by crossover adapter 132, attached to both packer mandrel 534 and mandrel 486.

Inner blank pipe 150 is attached to inner conduit 520, axial crossover passage 524 thus communicating with blank pipe bore 154 and outer blank pipe 152 is attached to outer conduit 514, blank pipe annulus 156 thus communicating with annular crossover passage 526; a tool string such as tool string 26 may be hung from blank pipes 150 and 152 as with crossover tools 28 and 228.

Unlike crossover tools 28 and 228, crossover tool 428 dispenses with a rotating slot mechanism altogether. Pin 482 provides a restraint to rotary motion on the part of sleeve 430; however, the same effect may be achieved by making a cooperating portion of mandrel 486 and sleeve 430 of non-circular cross-section. FIG. 10 illustrates crossover tool 428 in its open mode, while FIG. 11 depicts it in a closed mode, with tool bypasses 516 and 518 open, similar to that of crossover tool 228 in FIG. 7. Crossover tool 428 is changed from open to closed mode by pulling up on pipe 20 when the tool string below it is in position. This upward movement causes snap-ring 500 to ride up over collet 498 and onto collet skirt 496 where the frictional engagement between snap-ring 500 and collet skirt 496 will maintain sleeve 430 in a relatively raised position with respect to mandrel 486 until substantial weight is set down on pipe 20, again as when the tool string is anchored in place.

Gravel packing, utilizing crossover tool 428 in lieu of crossover tool 28 or 228, is effected in exactly the same manner. Packer inflation, circulation of slurry and reverse circulation are accomplished with the circulation passages open, and a squeeze, if desired, with the circulation passage 506 isolated by annular seals 468 and 470 on sleeve 430.

Although the invention has been described in terms of certain embodiments which are set forth in detail, it should be understood that those are by way of illustration and are not intended to limit the scope of the invention. Alternative embodiments of the apparatus and operating techniques of the method will be readily apparent to those of ordinary skill in the art in light of the disclosure. For example, the slot mechanisms set forth may be incorporated on the inner surface of the sleeves, with pins projecting from the mandrel, the rotating pin being carried on a ring resting in an annular groove in the outer surface of the mandrel. As mentioned above, relative rotation between the sleeve and mandrel of the tool can be prohibited by making at least a portion of their cooperating cross-sections non-cylindrical. The collet snap-ring mechanism could be replaced with a spring-loaded outwardly biased detent mechanism. A crossover tool such as 428 could be modified to incorporate a closed test mode with a detent mechanism in conjunction with the collet snap-ring device if a longer sleeve is added and an additional seal employed as with crossover tool 28. Accordingly, modifications such as these and others are contemplated without departing from the spirit and scope of the claimed invention:

We claim:

1. A crossover tool for use in a well bore, comprising:

body means having first and second passage means therethrough, said first passage means extending from the top of said body to the bottom thereof at a first location, said second passage means extending from at least one side of said body to the bottom thereof at a second location;

sleeve means longitudinally slidably disposed about said body means, said first passage means communicating with the bore of said sleeve means, said sleeve means having at least one port therethrough circumferentially aligned with said side extent of said second passage means and being juxtaposed therewith in a first sleeve position and longitudinally removed therefrom in a second sleeve position;

packer means disposed about said body means below the lowest point of longitudinal travel of said sleeve means;

selectively closeable bypass passage means in said body means extending from the outside of said body means above said packer means to the outside of said body means below said packer means; and selection means to select each of said positions in response to longitudinal movement of said sleeve means.

2. The crossover tool of claim 1, wherein said crossover tool is adapted to be hung from pipe means in said well bore by said sleeve means, whereby said sleeve means may be moved longitudinally.

3. The crossover tool of claim 1, wherein the closing of said selectively closeable bypass passage is controlled by said selection means.

4. The crossover tool of claim 3, wherein said selectively closeable bypass passage is closed at the upper end thereof by juxtaposition of said sleeve means therewith.

5. The crossover tool of claim 4 wherein said bypass passage is closed at said first sleeve position and open at said second sleeve position.

6. The apparatus of claim 5 wherein said body means is cylindrical and said selection means comprises slot means in the outer surface thereof, said slot means defining a path having horizontal and vertical components and having at least one recess therein; and pin means connected to said sleeve means, a free end of said pin means slidably confined within said slot means, whereby the longitudinal movement of said sleeve means with respect to said body means causes said pin means to follow the path defined by said slot means, and whereby, when said pin means enters said at least one recess, said sleeve means is locked at said second sleeve position.

7. The apparatus of claim 6 wherein:

said slot means comprises first and second slots, said first slot having a vertical component, and said second slot having vertical and horizontal components and at least one recess therein;

said pin means comprises first and second pins, one end of said first pin being fixed to said sleeve means, the free end of said first pin being slidably confined in said first slot, said second pin being fixed to ring means axially and rotationally slidably disposed about said mandrel means and rotationally slidably confined in an annular recess in said sleeve means, the free end of said second pin being disposed in said second slot, whereby, when said pipe is longitudinally reciprocated, said first pin prevents rotational movement of said sleeve means, and said second pin follows the path defined by said second slot to enter said recess, and upon subsequent longitudinal reciprocation, leaves said recess.

8. The apparatus of claim 7 further comprising snap-ring means, said snap-ring means comprising a snap-ring slidably disposed about said body means, longitudinally contained in an annular recess in said sleeve means and movable over collet means on the outer surface of said body means, whereby, when said sleeve means is moved longitudinally upward, said snap-ring will be moved into contact with said collet means, will expand and ride thereover to contract above said collet means, said sleeve means being thereby maintained in a relatively raised position by contact of said snap-ring means with said body means.

9. The apparatus of claim 8 wherein said contact is frictional contact.

10. The apparatus of claim 9 further comprising collet skirt means above said collet means on said body means, said collet skirt means increasing the outer diameter of said body means, whereby said frictional contact is increased between said snap-ring means and said body means.

11. The apparatus of claim 10 wherein said second slot means further comprises a channel horizontally spaced from said recess, said bypass passage being open when said second pin enters said channel, and being maintained open by said frictional contact.

12. The apparatus of claim 11 wherein application of force to said sleeve means sufficient to move said snap-ring downward over said collet means will cause said bypass passage to close, said second pin being in said channel.

13. The apparatus of claim 12 wherein said bypass passage is closed when said snap-ring means is below said collet means.

14. The crossover tool of claim 4 wherein said sleeve is longitudinally movable to a third position, said bypass passage is closed at said first and second positions, and said bypass passage is open at said third position.

15. The crossover tool of claim 6 wherein said bypass passage is opened during sleeve movement from one of said positions to another.

16. The apparatus of claim 15 wherein said body means is cylindrical and said selection means comprises slot means in the outer surface thereof, said slot means defining a path having horizontal and vertical components and having at least one recess therein, and pin means attached to said outer sleeve, a free end of said pin means slidably confined within said slot means, whereby the longitudinal movement of said sleeve means with respect to said body means causes said pin means to follow the path defined by said slot means, and whereby, when said pin means enters said at least one recess, said sleeve means is locked at said second sleeve position.

17. The apparatus of claim 16 wherein:

said slot means comprises first and second slots, said first slot having a vertical component, and said second slot having vertical and horizontal components and at least one recess therein;

said pin means comprises first and second pins, one end of said first pin being fixed to said sleeve means, the free end of said first pin being slidably confined in said first slot, said second pin being fixed to ring means axially and rotationally slidably disposed about said mandrel means and rotationally slidably confined in an annular recess in said sleeve means, the free end of said second pin being disposed in said second slot, whereby, when said pipe is longitudinally reciprocated, said first pin prevents rotational movement of said sleeve means, and said second pin follows the pattern defined by said second slot to enter said recess, and upon subsequent longitudinal reciprocation, leaves said recess.

18. The apparatus of claim 17 further comprising snap-ring means, said snap-ring means comprising a snap-ring slidably disposed about said body means and longitudinally contained in an annular recess in said sleeve means and collet means on the outer surface of said body means, whereby, when said sleeve means is moved longitudinally upward, said snap-ring will be moved into contact with said collet, will expand and ride thereover, to contract above sad collet, said sleeve being thereby maintained in a relatively raised position by contact of said snap-ring means with said body means.

19. The apparatus of claim 18 wherein said contact is frictional contact.

20. The apparatus of claim 19 further comprising collet skirt means above said collet means on said body means, said collet skirt means increasing the outer diameter of said body means, whereby said frictional contact is increased between said snap-ring means and said body means.

21. The apparatus of claim 20, wherein said second slot further comprises a second recess and a channel, both of which are disposed longitudinally above said first recess, and whereby said bypass passage is opened when said second pin means enters said second slot or said channel, and is maintained open by said frictional contact.

22. The apparatus of claim 21 wherein application of downward force to said sleeve means sufficient to overcome said frictional contact with cause said bypass passage to close.

23. A crossover tool adapted to be hung from a pipe disposed in a well bore, comprising:

body means having first and second passage means therethrough, said first passage means extending from the top of said body to the bottom thereof at a first location, said second passage means extending from at least one side of said body to the bottom thereof at a second location;

sleeve means connected to said pipe means and longitudinally slidably disposed about said body means, said first passage means communicating with said pipe through said sleeve means, said sleeve means having at least one port therethrough circumferentially aligned with said side extent of said second passage means and being juxtaposed therewith in a first sleeve position and longitudinally removed therefrom in a second sleeve position;

packer means disposed about said body means below the lowest point of longitudinal travel of said sleeve means;

selectively closeable bypass means, said bypass means extending from the outside of said body means above said packer means to the outside of said body means below said packer means;

selection means to select each of said sleeve positions and to selectively close said bypass means, said selection means comprising vertical slot means in said body means, pin means fixed to said sleeve means, the free end of said pin means being slidably disposed in said slot means, said selection means further comprising snap-ring means disposed about said body means and longitudinally constrained in an annular recess in said sleeve means, and collet means on said body means, said snap-ring means being expandable over said collet means and frictionally engageable with said body means thereabove, whereby, when said sleeve means is moved longitudinally upward with a force sufficient to expand said snap-ring over said collet means, said sleeve means attains said second position and is maintained therein by said frictional engagement and whereby said sleeve means may be returned to said first position by a downward force sufficient to expand said snap-ring over said collet means.

* * * * *